US006912488B1

(12) United States Patent
Saebi

(10) Patent No.: US 6,912,488 B1
(45) Date of Patent: Jun. 28, 2005

(54) METHOD OF CONSTRUCTING CURVED STRUCTURES AS PART OF A HABITABLE BUILDING

(76) Inventor: Nasser Saebi, 18231 N. 66$^{th}$ La., Glendale, AZ (US) 85308

( * ) Notice: Subject to any disclaimer, the term of this patent is extended or adjusted under 35 U.S.C. 154(b) by 0 days.

(21) Appl. No.: 09/563,241

(22) Filed: May 1, 2000

Related U.S. Application Data

(63) Continuation-in-part of application No. 09/398,387, filed on Sep. 17, 1999, now abandoned.
(60) Provisional application No. 60/100,856, filed on Sep. 18, 1998.

(51) Int. Cl.$^{7}$ ..... G06F 17/50; E04G 21/14

(52) U.S. Cl. ..... 703/1; 52/745.07

(58) Field of Search ..... 703/1; 52/80.1, 52/80.2, 81.4, 745.07, 741.41; 700/182

(56) References Cited

U.S. PATENT DOCUMENTS

| | | | | | |
|---|---|---|---|---|---|
| 3,932,969 | A | * | 1/1976 | Matras | 52/86 |
| 3,979,865 | A | * | 9/1976 | Boot et al. | 52/236.5 |
| 4,077,177 | A | * | 3/1978 | Boothroyd et al. | 52/745.07 |
| 4,092,810 | A | * | 6/1978 | Sumner | 52/81.4 |
| 5,272,642 | A | * | 12/1993 | Suzuki | 700/182 |
| 5,560,151 | A | * | 10/1996 | Roberts | 52/81.1 |
| 6,308,490 | B1 | * | 10/2001 | Saebi | 52/745.07 |

* cited by examiner

*Primary Examiner*—Kevin J. Teska
*Assistant Examiner*—Dwin M. Craig
(74) *Attorney, Agent, or Firm*—Albert W Davis, Jr.

(57) ABSTRACT

The invention uses foam blocks in commercially available sizes to build curved structure that are used in constructing habitable buildings. The curved structure is divided into sections using a Computer Assisted Drafting program. The foam blocks are cut to the curvature of the curved structure by a Computer Assisted Manufacturing program. The blocks are joined and then coated with a high strength coating to create the curved structure.

7 Claims, 26 Drawing Sheets

METHOD OF CONSTRUCTING CURVED STRUCTURES AS PART OF A HABITABLE BUILDING

This application is a continuation-in part of Application No. 09/398,387 filed Sep. 17, 1999 now abandond and titled CURVED COMPOSITE BUILDING SYSTEM which claims benefit of 60/100,856 filed Sep. 18, 1998.

BACKGROUND OF THE INVENTION

The majority of new buildings today rely on the old methods that use bearing walls or columns to support a heavy roof or an intermediate floor. Structures built in this way are susceptible to forces caused by gravity, adverse weather and earthquakes. The stresses in the buildings induced by these forces can cause cracks in and eventually the failure of the building. Internal stresses at the corners and joints of such buildings are amplified by the construction methods. Failure of such buildings is initiated at their weakest points.

Conventional structures use massive quantities of materials and require excessive amounts of labor time and energy to construct. Forests are cut down to provide the lumber. Energy is expended to mine and create metal beams and components which carry the weight of the other building materials. Furthermore, a great amount of human, machine and combustible fuel energy is needed to transport and assemble the materials at job site.

Architects are designing buildings that are pleasing to the eye but are expensive to build. The buildings have curved surfaces which are very expensive to construct.

There has been a need for a method of creating a structure, such as a home, a vault for a mall, a sports stadium, etc. from less expensive materials and labor and a need for a method of building the structures more quickly. Further, there has been a need for creating buildings that are more resistant to the forces of nature.

BRIEF SUMMARY AND OBJECTS OF THE INVENTION

One object of the invention is to provide an inexpensive method of creating structures of considerable strength while creating a building of customary appearance.

Another object is to be able to create structures of arbitrary curvature form inexpensively without the need for a structural skeleton.

A further object is to create structures of high strength out of lightweight materials in commercially available sizes by incorporating curved, dome-like or shell-like structures into the building.

Another object is to provide a transparent structure of considerable strength which could be used to create stadiums, arenas and sport complex roofs.

A further object is to create a fiber or cable reinforced, curved structure of very high strength.

Another object is to create an inexpensive method of making transparent structures, such as skylights, domes, vaults and canopies, which is of especial interest in the construction of malls and many other structures.

A further object is to provide a method for creating a virtual structure having curved portions in a computer, then sectioning the structure by the computer program into smaller, more manageable sections, forming the curved sections from flat/planar pieces. The forming step can be accomplished by feeding the data from the computer assisted drafting (CAD) program to a computer assisted machining program (CAM) in a cutting machine.

Another object is to make a 3-D curved structure without the use of expensive forming processes. Before the development of CAD-CAM, such a curved structure would have been very expensive to create.

A further object is to create buildings more quickly.

A further object is to build the structure in portions made from joining sections until the combined sections are of an appropriate size to be raised to form a portion of the structure.

Another object of the invention is to make a structure that is more resistant to the external forces experienced during snow, winds and earthquakes. This is accomplished in two ways. First, the weight of the structure is reduced. Second, the strength of a curved shell is exploited.

DESCRIPTION OF THE PREFERRED EMBODIMENT

Figure 1:
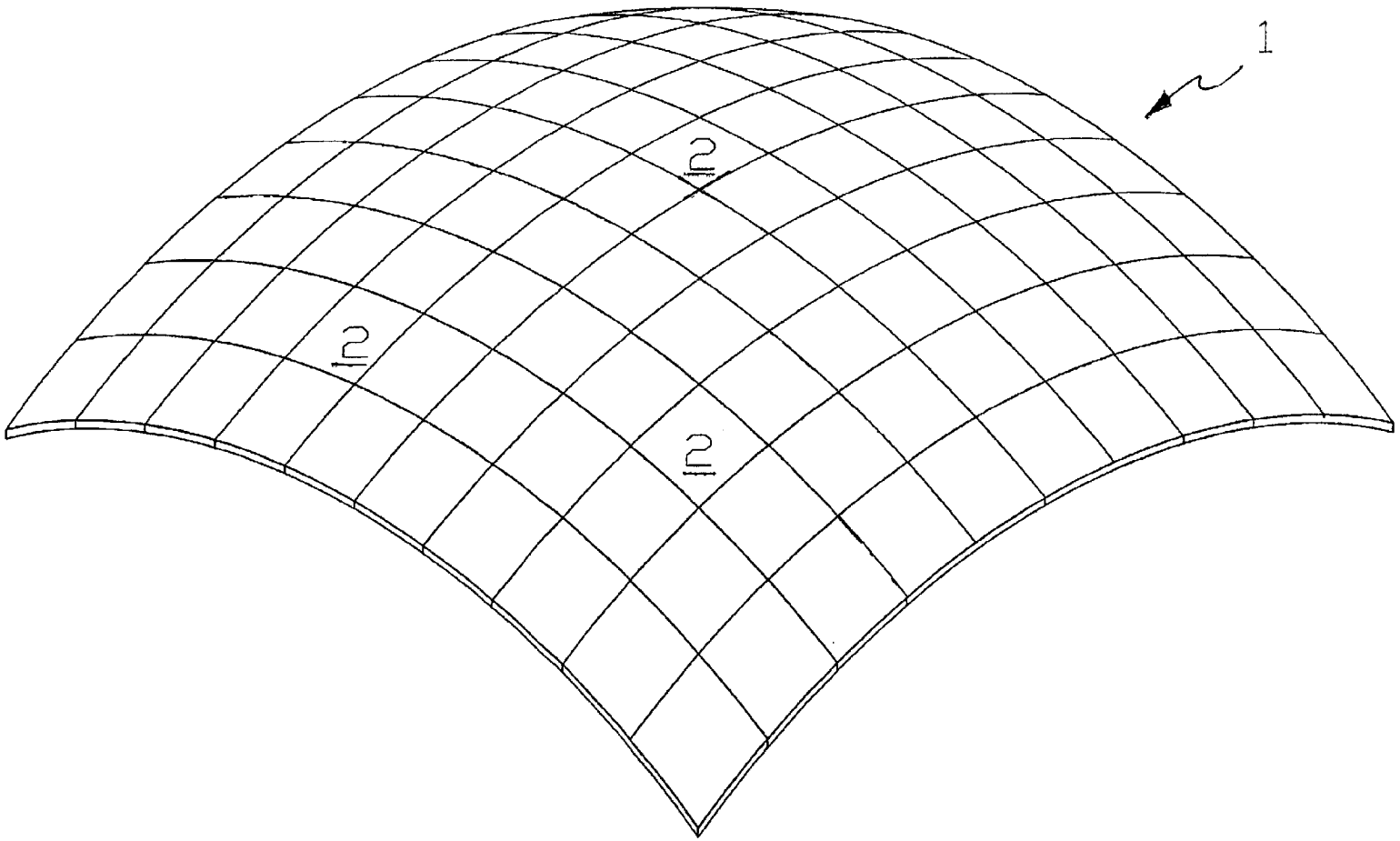
FIG. 1 is a perspective view of the curved structure.

FIG. 1 shows a curved composite structure 1 formed of curved sections 2 having a rectangular form. The curved sections 2 can have a triangular form, a pentagonal form or any other multi-sided form. The curved sections 2 are formed from flat sides 3,4,5,6 and top and bottom flat panels 7 and 8.

Preferably, the materials used in the sides and panels are plastics, such as acrylics, polycarbonates, etc. The plastics can be transparent, translucent, opaque or a combination depending on the requirements of the section. The thickness of the top and bottom panels is typically in the range of one sixteenth to one half of an inch.

Figure 2:
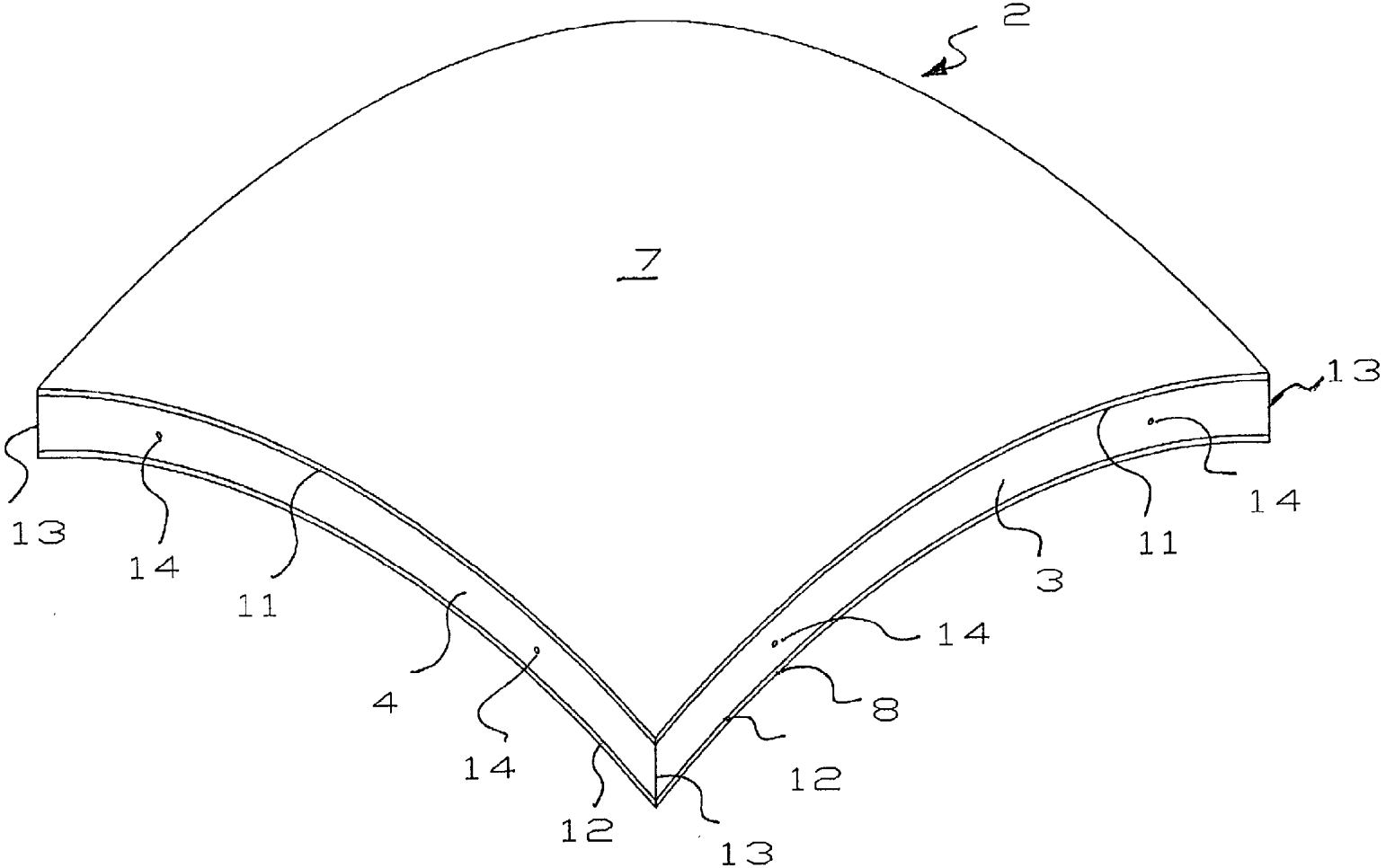
FIG. 2 is a perspective view of a rectangular, curved section of the curved structure.

In FIG. 2, one curved section 2 is shown. The curved section 2 is shown to have a very mild or gentle curvature. Such a curvature is created by a very large radius of curvature. The section 2 is part of a dome structure 1 and is therefore curved in two directions. As is shown more clearly in FIGS. 2 and 3, the sides 3–6 are formed so that their top and bottom edges are curved. The sides are joined to create a multi-sided form/frame 9 upon which the flat top and bottom panels are bent and secured.

The curved section could be created by just having sides with curved top or bottom edges and top or bottom panels, respectively. When the panel 7 or 8 is bent to form a gentle curve, the panel stress level will usually be in the elastic deformation range. Thus, there will be residual stresses in the panel trying to return it to a flat configuration. Those stresses are very low.

Figure 4:
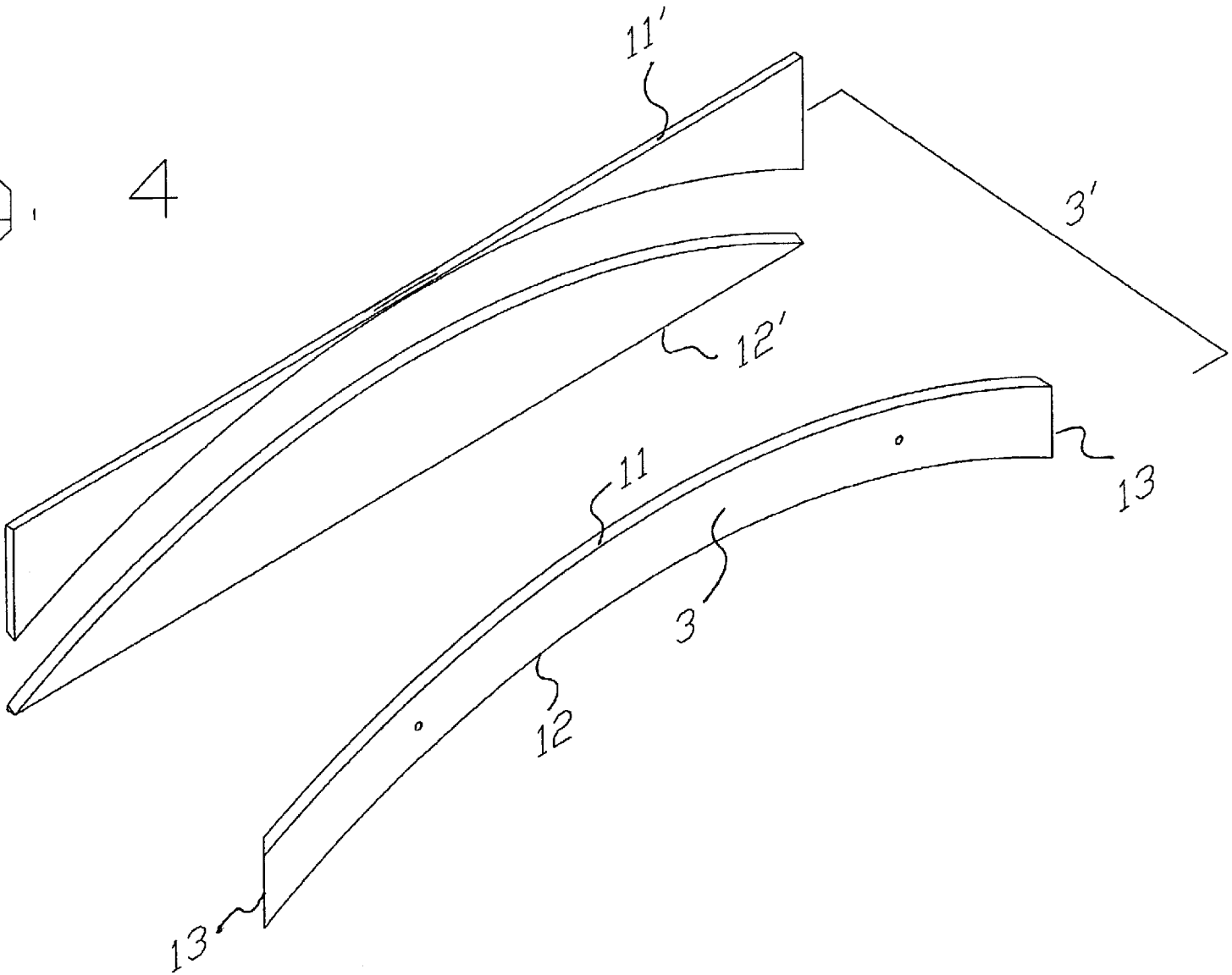
FIG. 4 shows a front view of one of the sides.

FIG. 4 shows a side 3 which is used to form the composite curved structure section 2. The side 3 has an upper edge 11 and a lower edge 12. The edges 11 and 12 are formed with a curvature that matches the desired curvature of the section 2 of the composite curved structure 1. The edges 11 and 12 can be formed by removing material 11' and 12' from a straight edged, flat piece of material 3'.

The removal of material can be performed by a computer operated cutting machine, having a rotating cutting device much like a router, that is fed information from the computer generated (virtual) structure that is to be built. The curvature can also be formed by casting the side with the desired curvature in a mold.

Figure 5:
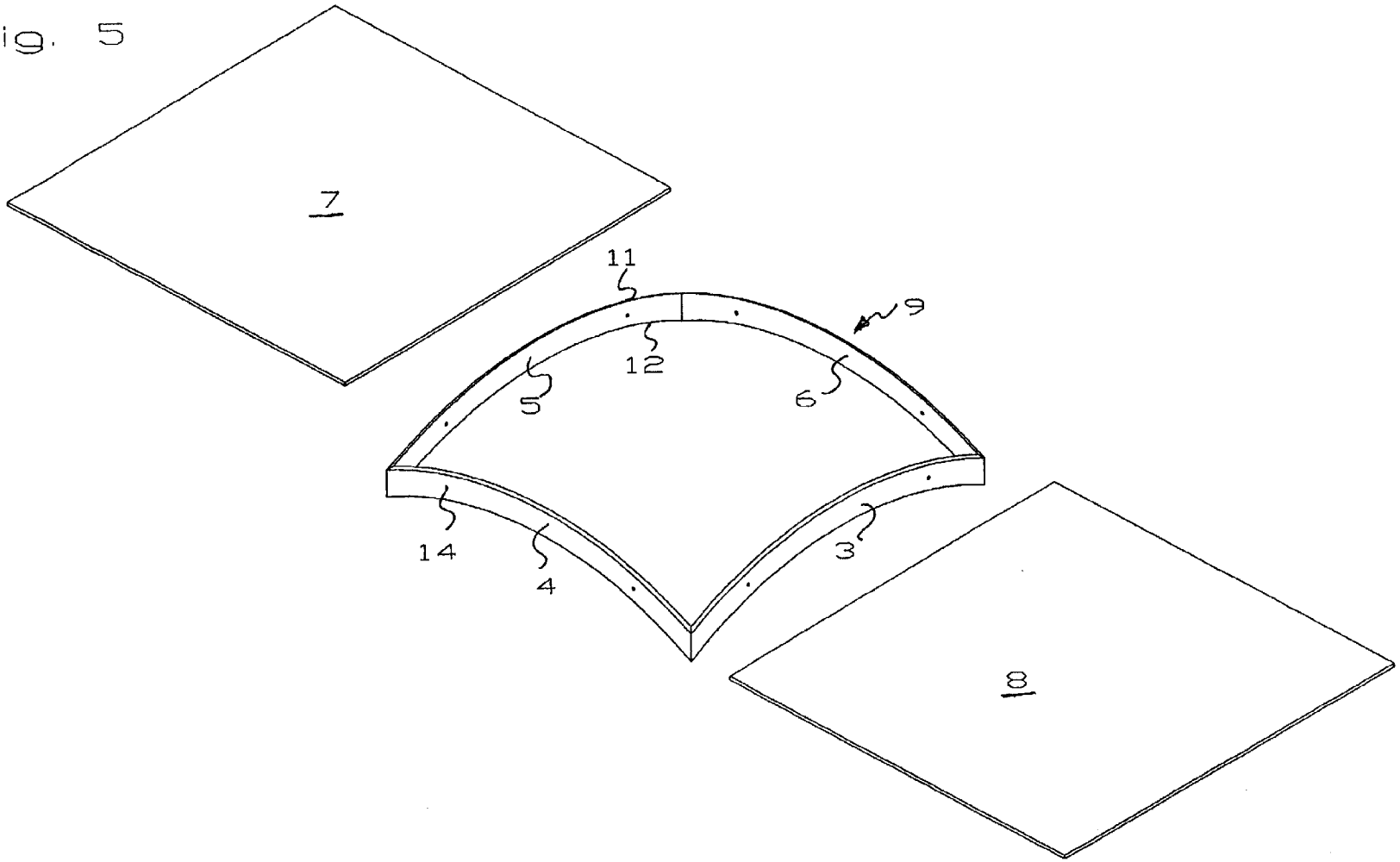
FIG. 5 shows an exploded view of the pieces making a section with the top and bottom panels being shown as they are before they are bent on to the frame.

FIG. 5 shows top panel 7 that is rectangular and similar in shape to the bottom panel 8, only larger. The top and bottom panels 7 and 8 are made from flat/planar elements. In an application as a skylight, the panel is made of transparent or translucent plastic.

The section 2 is formed by joining sides 3,4,5,6 to create a form or frame 9, placing panels 7,8 on the form/frame 9 created by the joined sides, and bending and joining the top and bottom panels 7,8 to the sides 3,4,5,6. Thus, the curvature of the section 2 is created by cutting away material 11' and 12' to form the desired curvature of edges 11,12, by cutting the top and bottom panels 7, 8 to rectangles to match the area of the form or frame 9 defined by the joined sides, by bending the panels 7,8 on to the sides 3–6 to match the curvature of the sides, and by joining the top and/or bottom panels 7,8 to the sides 3–6.

In FIG. 2, sides 3,4,5,6 are joined along edges 13 to each other. Top and bottom panels 7 and 8 are bent on and joined to the upper and lower edges 11 and 12. The bending is done during the joining operation. The panels are bent and held in place during the joining operation. The holding in place step can be accomplished by the use of tape, a hold down fixture or jig, tack welds, rivets, etc.

The joining of the sides 3–6 to each other can be performed by using a solvent for the plastic material from which the sides are made.

The joining of the panels 7,8 to the frame 9 created from the sides can be performed by adhesives, welds, mechanical devices such as rivets, etc. One such adhesive is WELD-ON 40TM, a Clear Two-Component, Reactive, High Strength Acrylic Cement used for joining acrylic materials. Another adhesive is a solvent for the plastic material from which the sides and the panels are made. The welding could be performed hot plate welders which apply heat to the areas to be welded.

Figure 3:
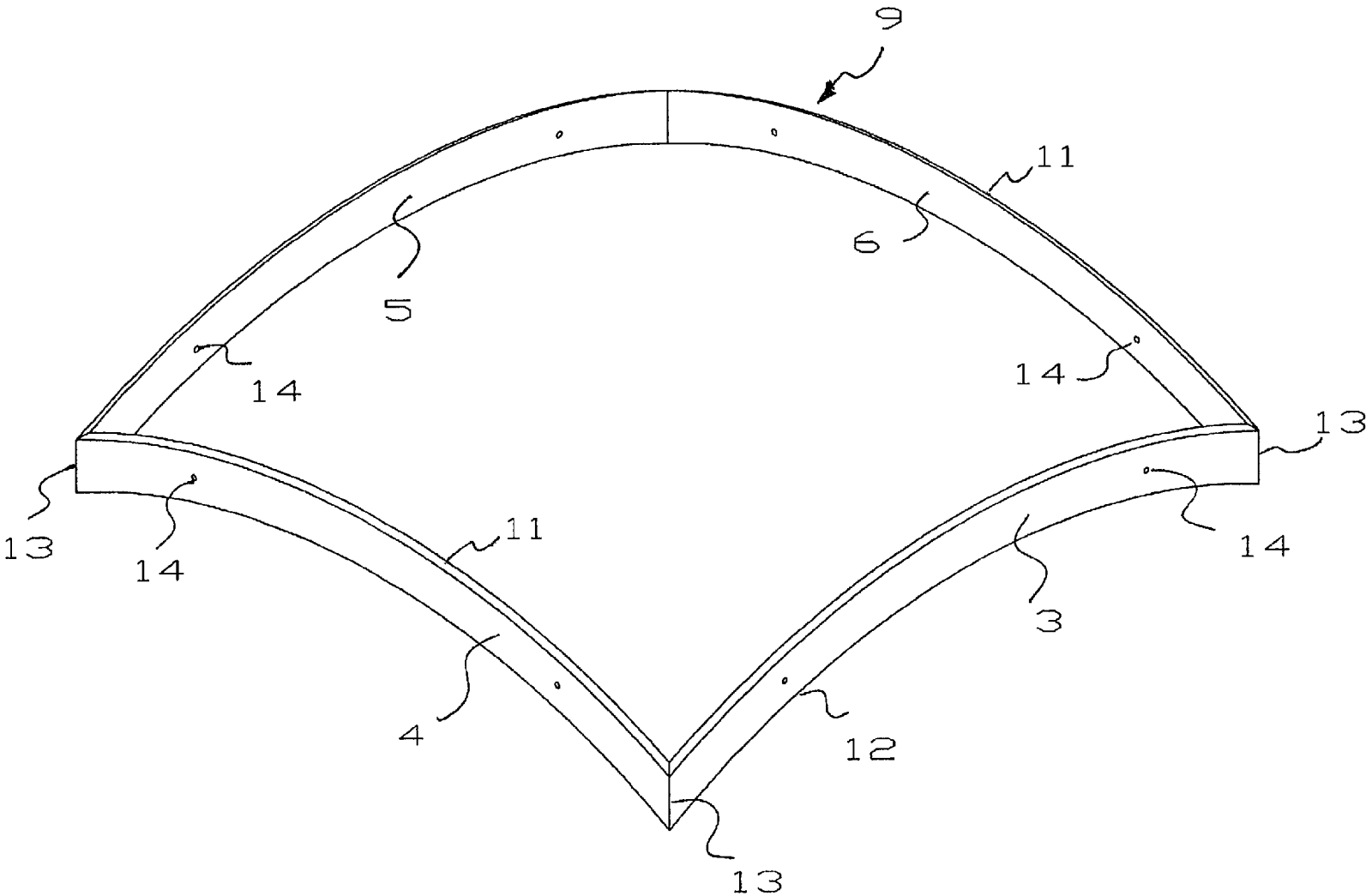
FIG. 3 is a perspective view of the four sides of the curved section which create a form or frame.

The joints can be butt joints where the edge 13 of one side abuts the side of another side. Preferably as seen in FIG. 3, the side joints can also be made by chamfering the edges 13 at an angle of 45 degrees so that they can be joined to form the 90 degree corner of a rectangle. Of course, different angles of chamfer would be used for different forms of multi-sided sections.

The section 2, when made of clear or translucent materials, can be used by itself or with other sections as a window or skylight. When made of opaque materials, the section or sections can be used to form other types of curved structures.

The structure of FIG. 1 can be created in a computer as a virtual structure by the use of a computer assisted drafting (CAD) program. The structure can be divided by the CAD program into pieces/sections using either Cartesian or polar coordinates. Using Cartesian coordinates, the structure would be divided along X,Y and Z axes. Using polar coordinates, the structure would be divided by lines radiating from a point. The division of the structure into sections allows the structure to be made of planar pieces or sheets in sizes that are commercially available, such as 4×8 feet, 5×10 feet, etc.

The planar sections can be cut by the use of a computer assisted cutting machine (CAM). The data from the CAD program is fed into the CAM which then cuts the planar sections, such as the sides, the top and the bottom panels. The sides have the top and bottom edges cut to the desired curvature. The top and bottom panels are cut to fit the form or frame created by the joined sides. The cut planar pieces can be assembled to form sections in the field or in a factory and then transported to the field. The sections are then assembled to form the structure.

Figure 6:
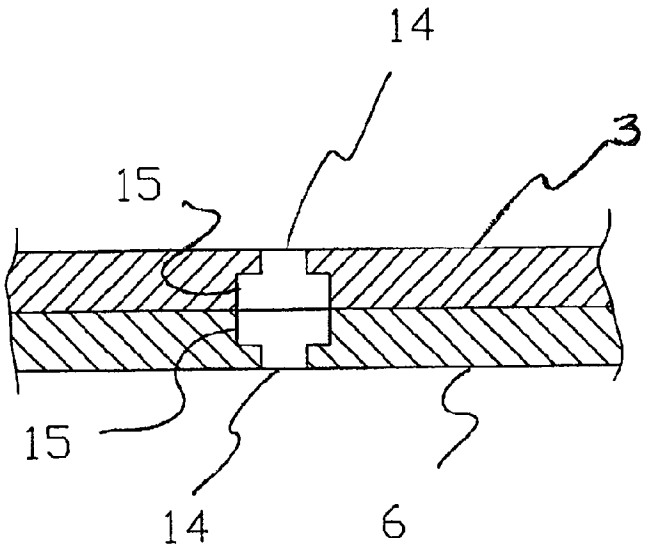
FIG. 6 is a cross-sectional view of alignment holes in the adjacent sides.
Figure 7:
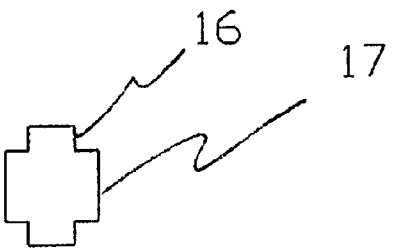
FIG. 7 is a front view of an alignment pin.

As shown in FIGS. 2, 3 and 6, the sides 3–6 can have alignment holes 14. Preferably, the aligned holes 14 are formed with a countersunk portion 15. FIG. 7 shows a pin 16 having a shoulder 17 which fits into the countersunk portion 15 of the hole to prevent the pin 16 from falling into the inside of section 2. Sections 2 are assembled side by side and aligned by the use of holes 14 and pins 16. Each side is shown as having two holes 14 to more quickly achieve alignment.

To assemble, the pin 16 is placed in hole 14 until shoulder 17 seats in countersunk portion 15. Then, the abutting section 2 is aligned with aforementioned section by placing the seated pin in the hole of side of the adjacent section. The shoulder 17 need not fit the whole of the countersunk portion 15. Further, both holes 14 need not be countersunk. Further, no countersink would be needed where a pin is bonded in the hole of one side. Of course, other types of alignment devices can be used.

Figure 8:
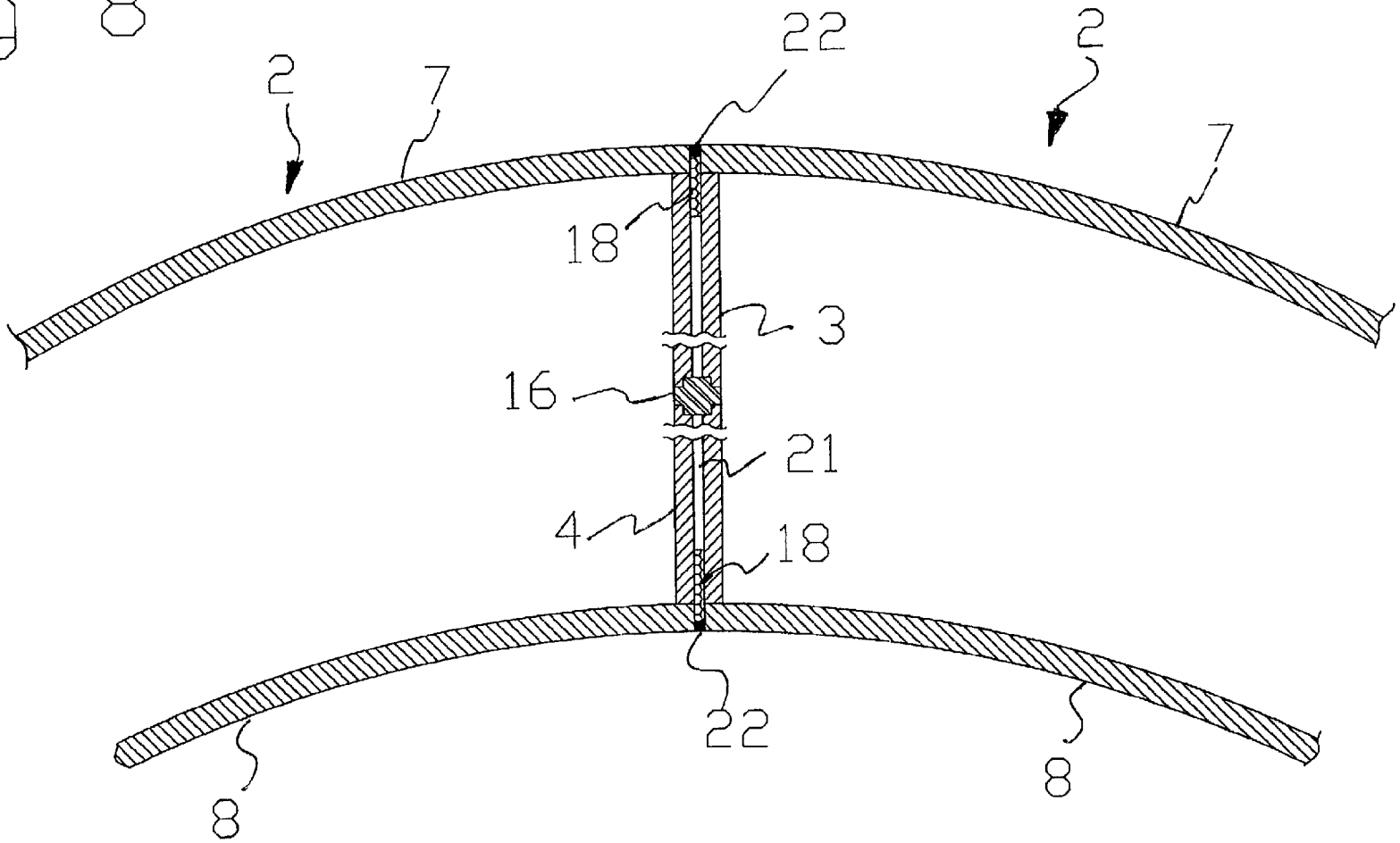
FIG. 8 is a cross-sectional view of joined adjacent sides.

FIG. 8 shows two sections 2 assembled side by side/adjacent. Sides 3–6 have an adhesive 18 applied to the top portion by any applicable means such as nozzle, spray, roller, brush or tape. Suitable adhesives are 3M's VHB TM Coated Acrylic Foam Tapes and Adhesive Transfer Tapes (4905–4959 and F4960PC–F4973PC) or 3M's SCOTCH GRIP TM Plastic Adhesives (1099,1099L). The tape applicator would have at least one protective backing to make it easy to handle. The backing is used to lay the adhesive on the sides 3–6, and then the backing is peeled off exposing the adhesive for contact with the adjacent side wall 3–6 or any adhesive applied to the adjacent side.

In the embodiment of FIG. 8, the adhesive 18 is placed at the top of area of the sides. The adhesive 18 forms a dam in the space/gap 21 between the adjacent sides 3–6 and panels 7,8. The thickness of the adhesive forms a gap 21, typically of about 0.05 inches, between the edges of the top panel 7 of adjacent sections. Preferably, the adhesive 18 should never fully harden so that it will be prevented from forming a high stress in the sides.

Another adhesive 22 can be placed in the gap 21 created by the dam formed by adhesive 18. Typical adhesives 22 can be WELD ON 40 TM, 3M's VHB TM Coated Acrylic Foam Tapes, such as 4905 and 4910, or a solvent for the plastic of the side, such as a solvent for acrylics, polycarbonates, etc., which will melt the surface of the plastic of the adjacent surfaces thereby allowing the plastic to flow and bridge the gap where it solidifies.

Figure 8A:
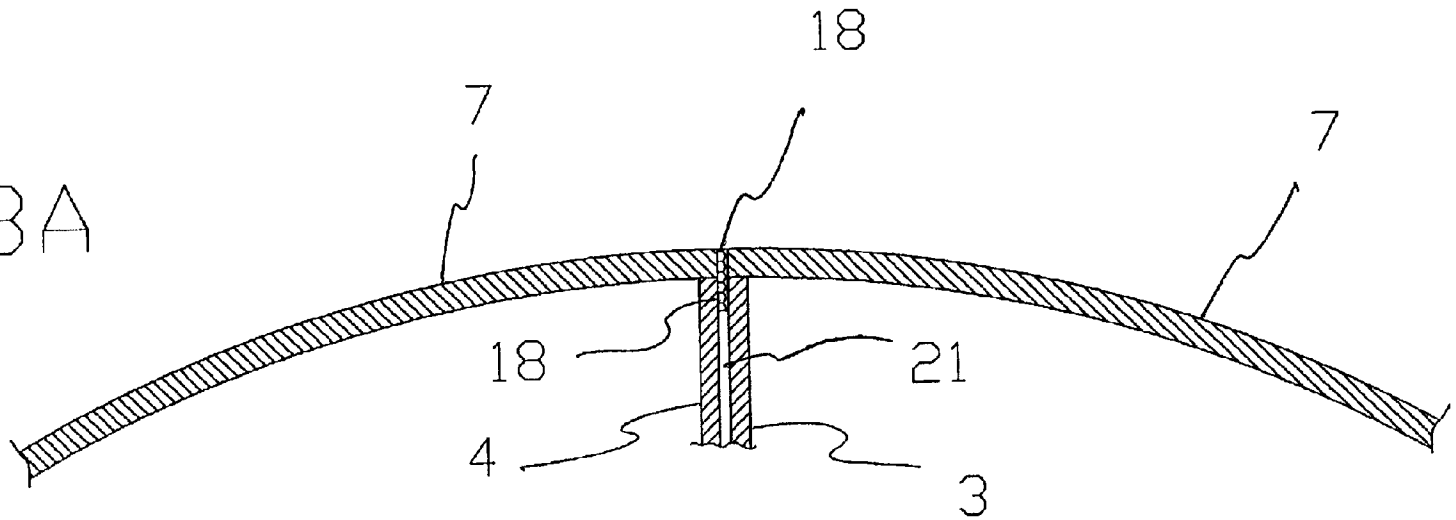
FIG. 8A is a cross-sectional view of another embodiment of the joined sides.

In another embodiment shown in FIG. 8A, only 3M's tapes, 3M's VHB TM Coated Acrylic Foam Tapes and Adhesive Transfer Tapes (4905–4959 and F4960PC–F4973PC), are used. The tape 18 will fill the gap 21 and extend onto the side 36, and there will be no need to form a dam since the adhesive on the tapes will not run. During the assembly, the adhesive 18 is placed on the sides before the sides are aligned adjacent to each other. The gap 21 between the top panels can be filled with an adhesive 18 or 22, a caulk or left unfilled or partially filled.

The bottom panels 8 can be united by the same assembly steps. The structure 1 can be created by using either of the top panels, the bottom panels or both.

Figure 9:
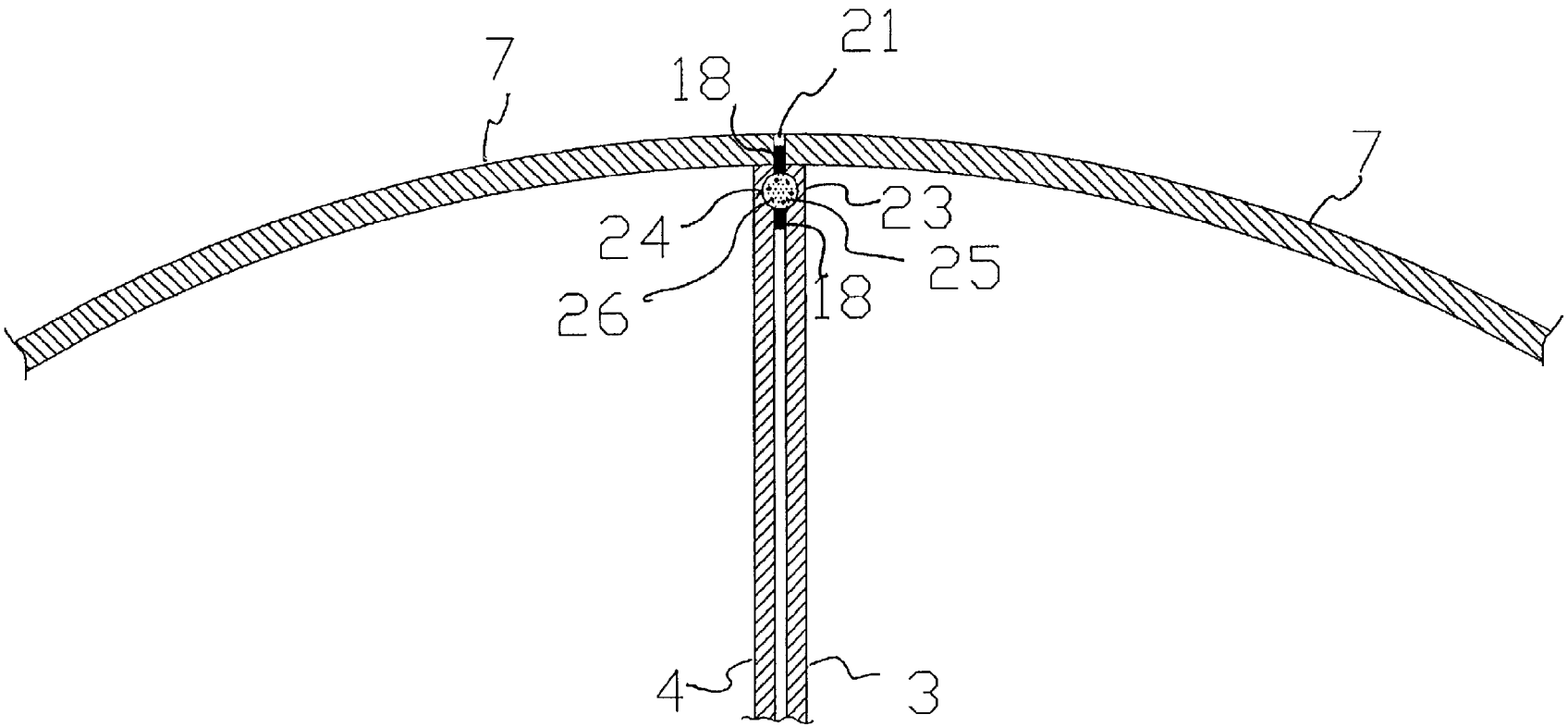
FIG. 9 is a cross-sectional view of a further embodiment of the joined sides.

FIG. 9 shows sides 3,4 formed with cavities 23, 24. The cavities 23,24 form a larger cavity which is sealed by the dams created by adhesive 18 which is applied along the top and bottom edges of the cavities 23,24. The cavities 23,24 are filled with a bonding agent 25 which can be the liquid, unset form of the plastic that is used for the side, such as a liquid acrylic if using acrylic sides. The bonding agent may contain fibers, cables or ropes 26 for reinforcement. The fibers, cables or ropes 26 can be made of FIBERGLAS TM, carbon, graphite, etc. The bonding agent 25 reinforced by fibers, cables or ropes is used to increase the strength of the structure 1. The gap 21 can be filled with an adhesive 18 or 22, a caulk or left unfilled or partially filled.

Figure 10:
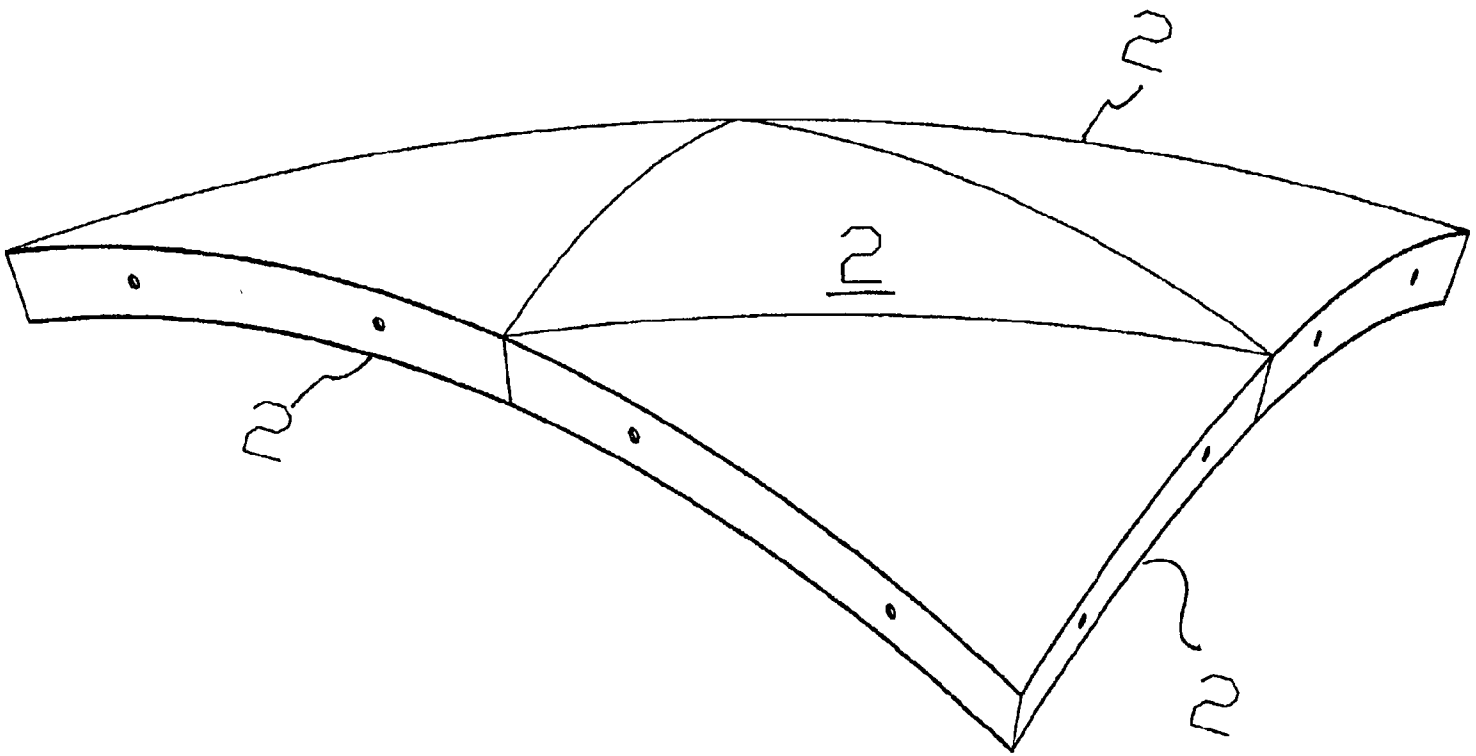
FIG. 10 is a perspective view of a curved structure formed from triangular sections.

FIG. 10 shows a curved structure 1 in the shape of a portion of a dome. The dome can be divided into triangular curved sections 2. Only four triangular sections 2 are shown in FIG. 10; however, the whole dome is made of curved triangular sections. The sections are similar to the rectangular sections of FIG.

Figure 11:
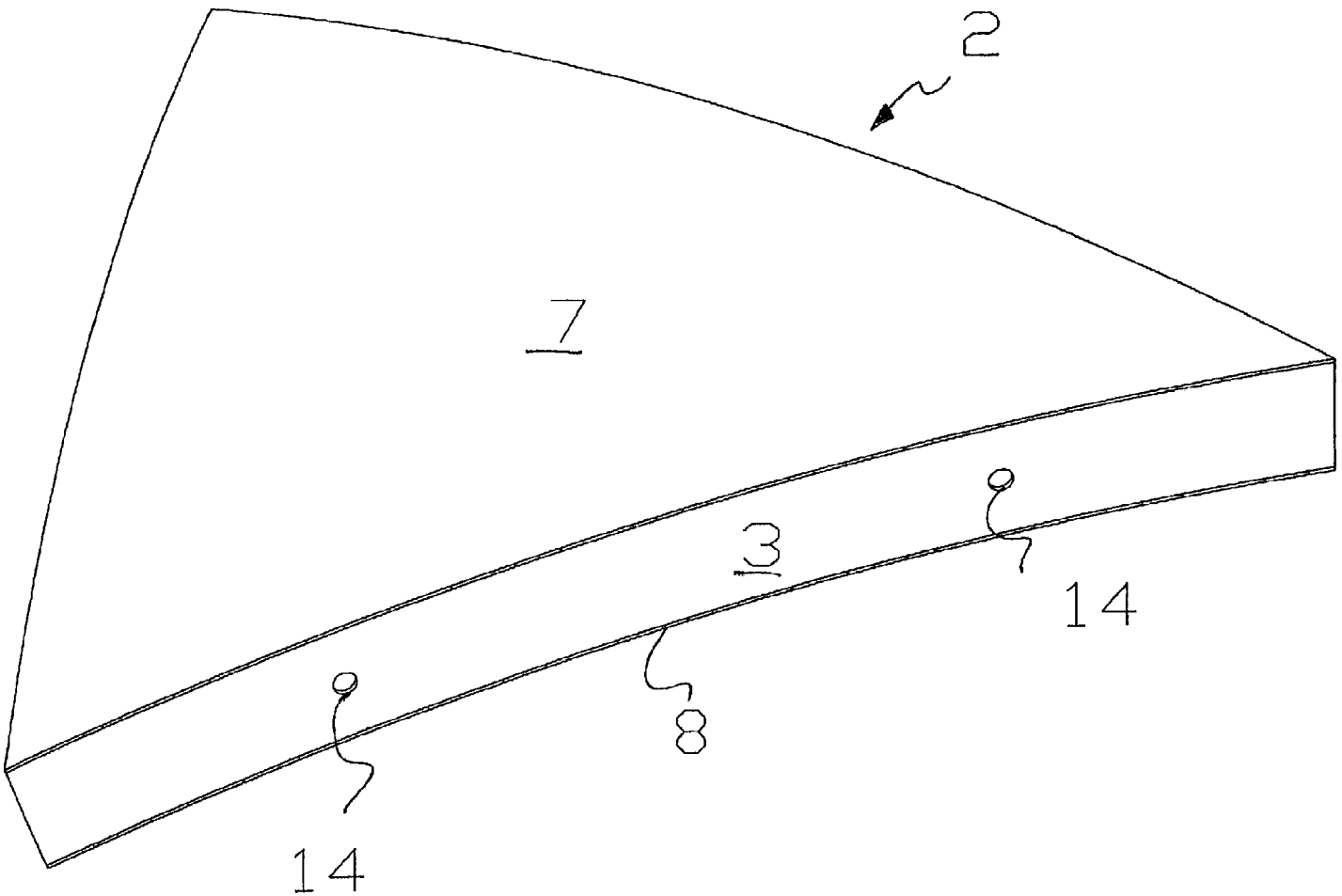
FIG. 11 is a perspective view of a triangular section.
Figure 11A:
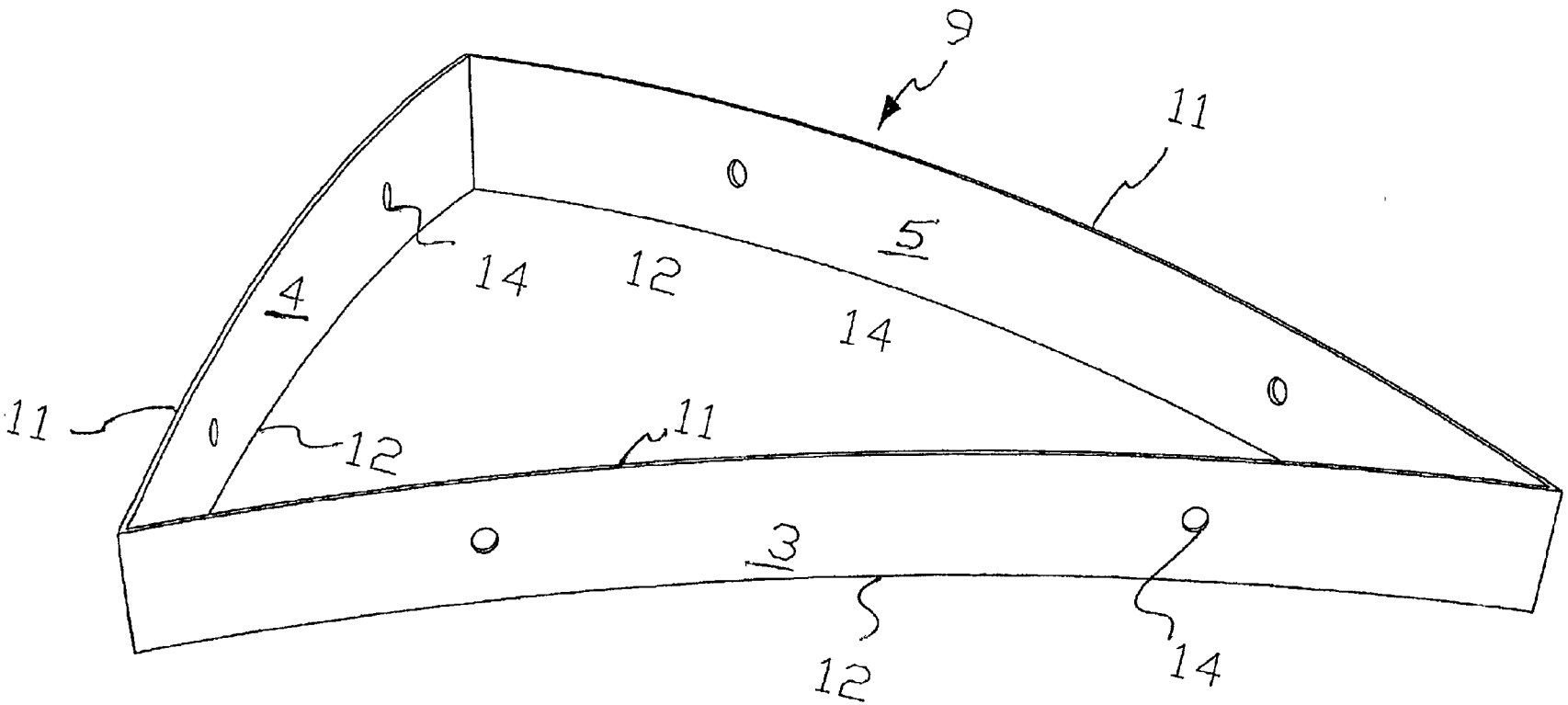
FIG. 11A is a perspective view of the joined sides of a triangular section.

FIGS. 11 and 11A show a section 2 in the triangular form of FIG. 10. There are three sides 3–5, preferably equal in length and a top and bottom panel 7,8. The sides 3–5 are formed with curved top and bottom edges 11,12 to match the curve of the dome. The sides 3–5 are joined to create a form or frame 9. The triangular top and bottom panels 7,8 are placed on the form created by the edges 11,12, bent to match the curve of the edges 11,12 and then joined to the edges.

Figure 12:
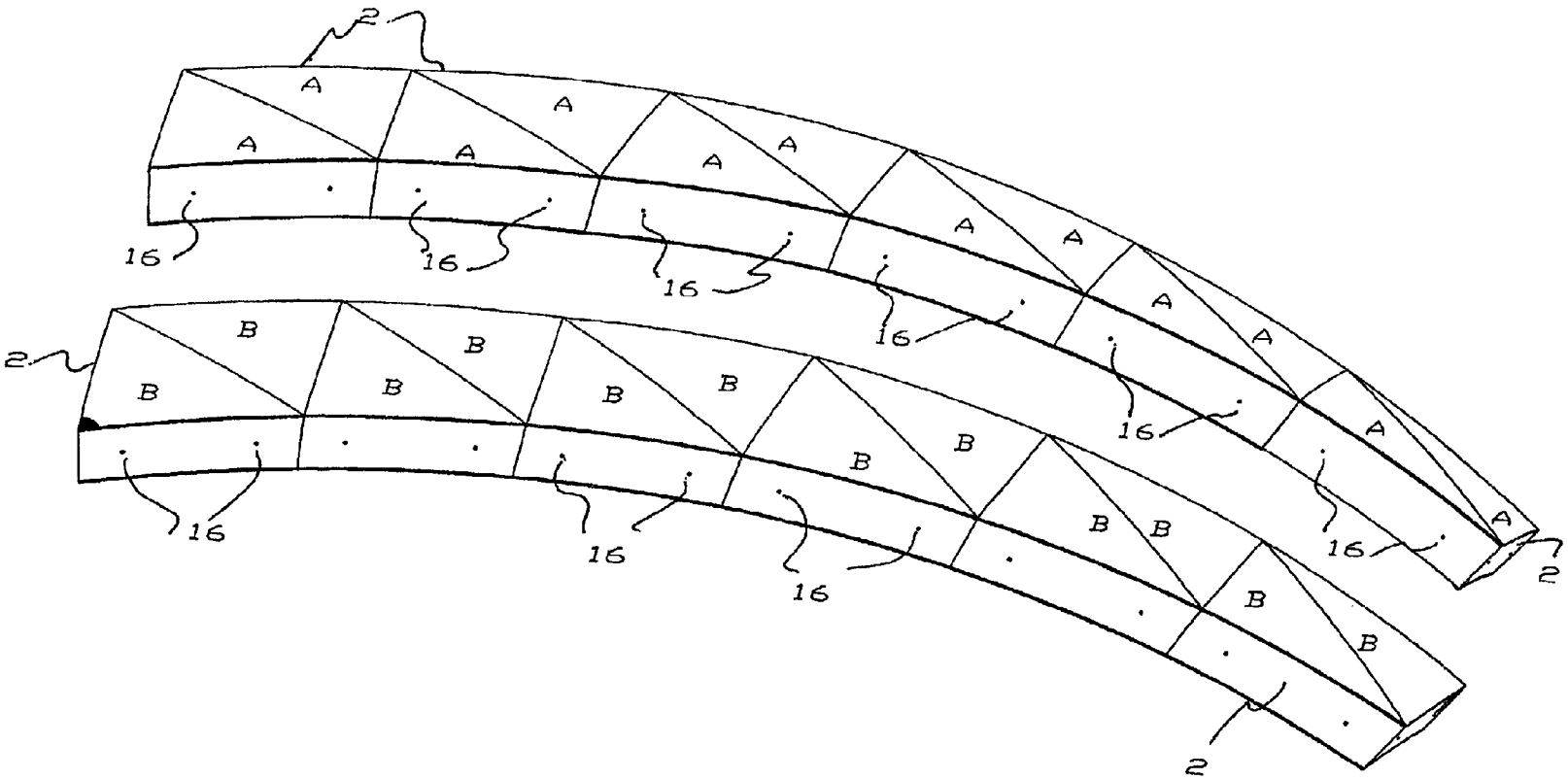
FIG. 12 is an exploded, perspective view of groups of joined panels.

FIG. 12 shows two groups A,B of triangular sections 2 that have been joined together by adhesives. The joined groups A,B are joined to each other by placing adhesives 18 on the sides 3–5, then aligning the pins 16 in holes 14 (not shown) and pressing the sides of group A to the sides of group B. Eventually, two halves will be joined by the aforementioned technique to form the dome.

Figure 13:
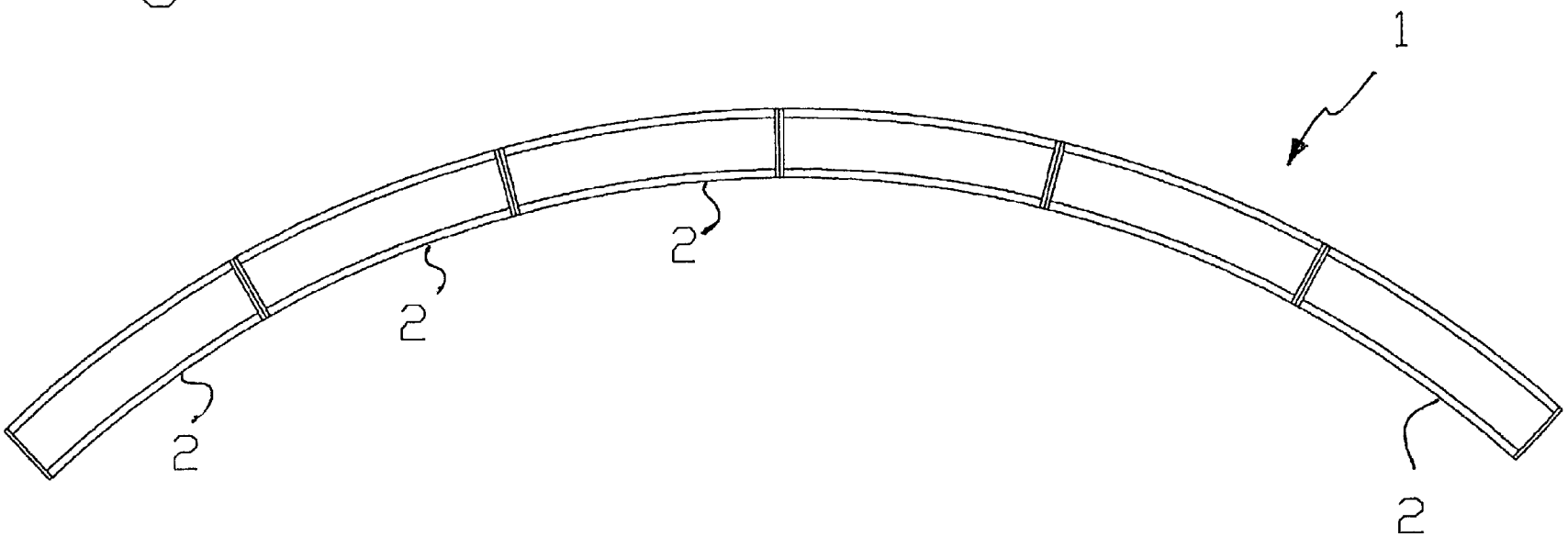
FIG. 13 is front view of a curved structure in the form of a vault.

FIG. 13 shows a curved structure 1 formed as a vault-like roof for a walkway or other use. In this form, the sections may be curved in only one direction, instead of two as required for a dome. That is, only two opposite sides 3,5 or 4,6 will have their upper and lower edges 12,13 formed to match the desired curvature of the vault.

Figure 14:
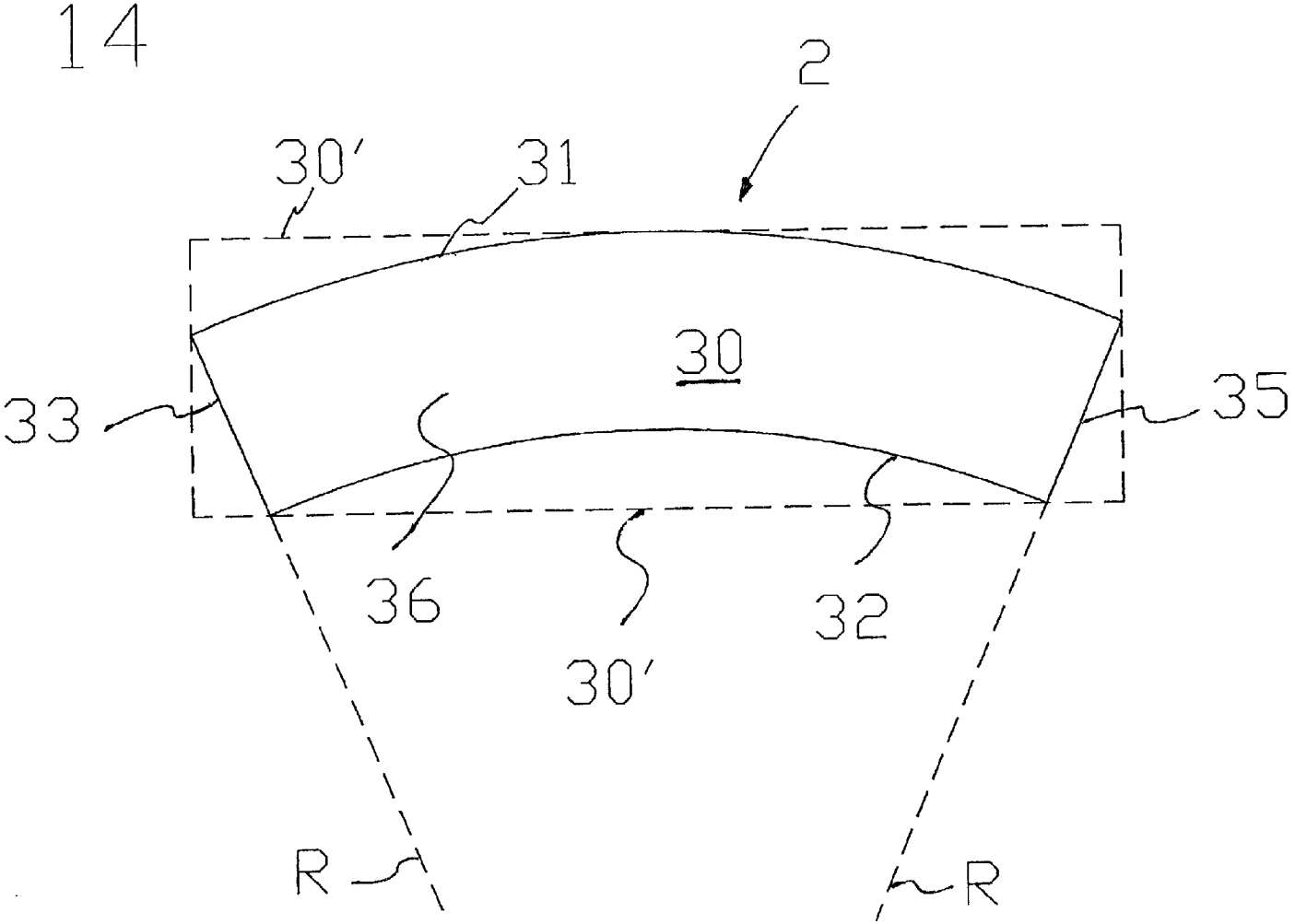
FIG. 14 is a side view of a block used in a second, different embodiment of the invention.

FIG. 14 shows a different embodiment of the overall concept of creating strong, lightweight curved structures. In this embodiment, the rectangular sections 2 are formed from core materials, such as, rectangular, expanded polystyrene solid panels 30'. Rectangular, solid formed panels or blocks 30 have curved upper and lower surfaces 31 and 32 and four tapered sides 33–36. Sides 33 and 35 have a taper that is dictated by the radius of curvature R in a first direction of the curved structure 1 of which section 2 is a piece. If the structure 1 is curved in first and second directions, sides 34 and 36 will also have a taper dictated by the radius of curvature taken along the second direction. The shape of the panel or block 30 is shown somewhat exaggerated to clearly show the curvature and the taper. In another embodiment (not shown), either the top or the bottom surface of the foam block is left flat and the bottom or the top, respectively, is formed in the desired curve.

The curved rectangular, formed foam block 30 can be formed from a flat-sided block of core material 30' by using a computer assisted cutting machine (CAM) having a rotating cutter much like a router. The procedures to be followed would be similar to those previously discussed. The blocks can also be cut by a device called a hot wire. Another method of forming would cast the rectangular, solid panel 30 with tapered sides and curved upper and lower surfaces. As in the previous embodiment, the blocks or panels 30 can have a triangular form, a pentagonal form or any other multisided form.

Preferably, the blocks 30 would be sized so that they could be cut from core material blocks 30' that are manufactured in commercially available sizes, such as 4×8 feet, 5×10 feet, etc.

Figure 14A:
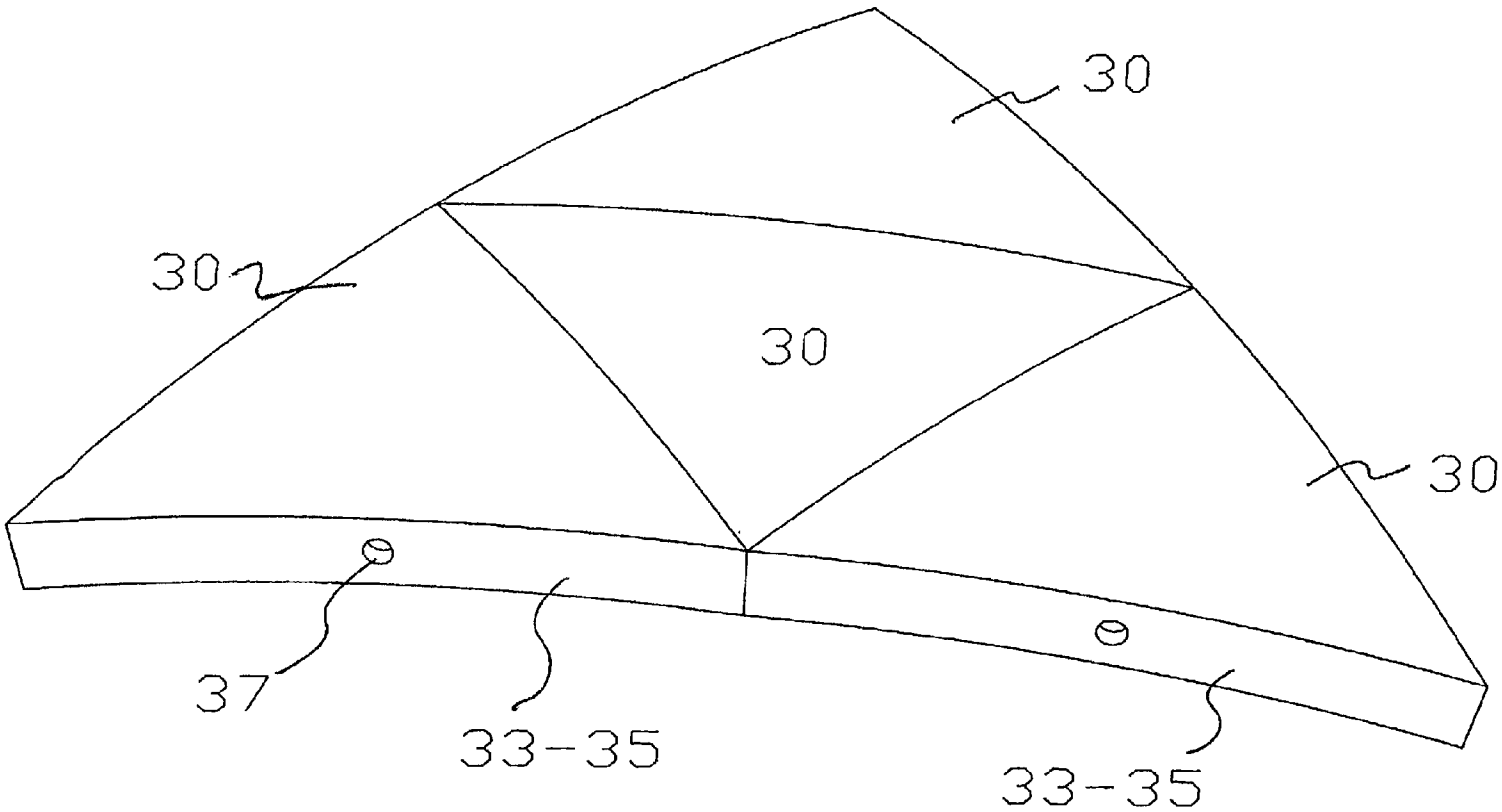
FIG. 14A is a perspective view of the second embodiment formed from triangular sections.

FIG. 14A shows the four foam blocks 30 of a triangular form joined together.

Figure 14B:
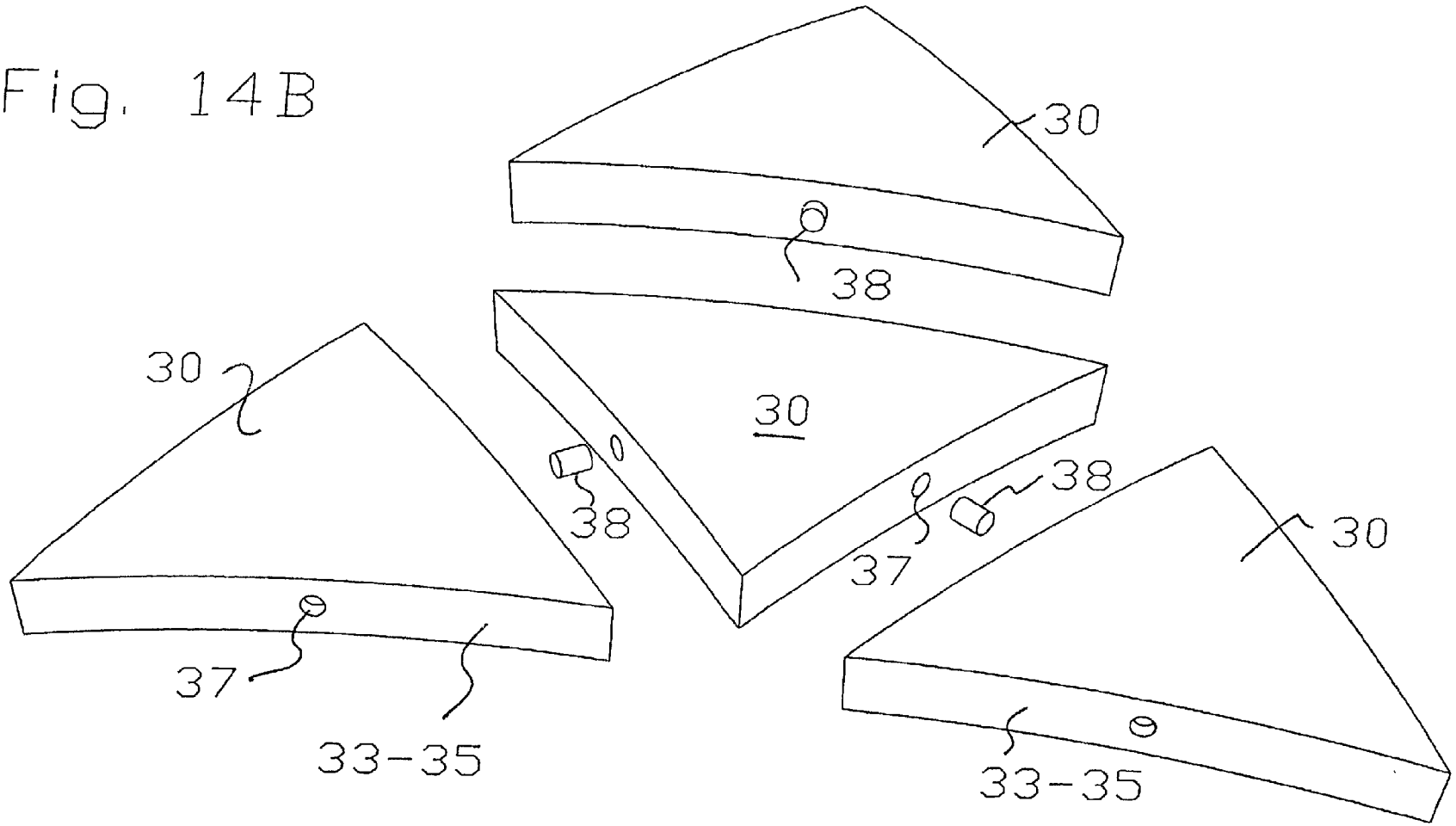
FIG. 14B is a exploded, perspective view of the sections of FIG. 14A.

FIG. 14B shows an exploded view of the four foam triangular blocks with holes 37 and pins 38 for alignment of the blocks.

Figure 15A:
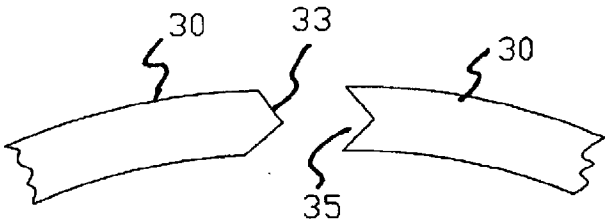
FIGS. 15A–C are exploded, side views of different embodiments of the joint between adjacent blocks.
Figure 15B:
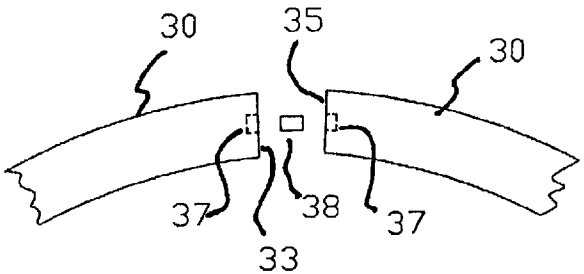
Figure 15C:
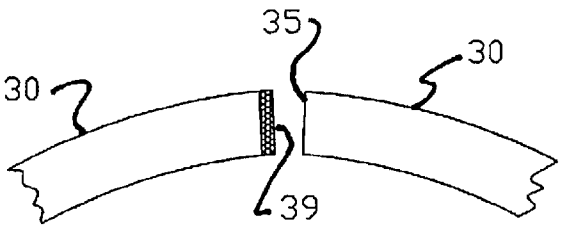

The blocks 30 are assembled as shown in FIGS. 12, 14B and 15. The sides 33–36 are affixed to an adjacent block by any suitable means, such as, adhesive, interlocking joints, etc. or combination thereof. The interlocking joint could typically be a tongue and groove design, as shown in FIG. 15A, formed on sides 33–36 of the blocks 30. The blocks 30 can also be aligned by using the tongue and groove interlocking joint or a pin 38 and hole 37 interlocking joint, as shown in FIG. 15B, in which the pin 38 of about an inch in diameter fits in holes 37 in adjacent blocks 30. A suitable foam adhesive 39, as shown in FIG. 15C, would be 3M FASTBOND TM Foam Adhesive 100 which is a neoprene based product. Preferably, the blocks 30 are joined by using an adhesive and an interlocking joint.

Figure 16:
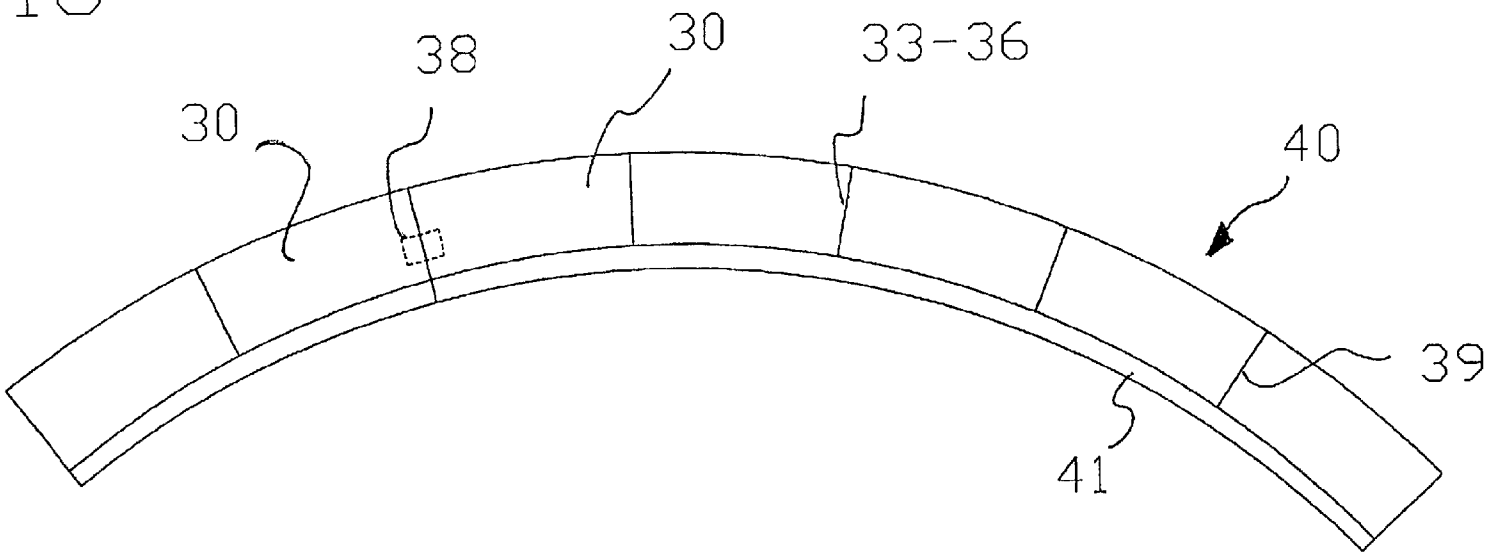
FIG. 16 is a side view of an assembly of blocks.

As shown in FIG. 16, once the desired number of blocks 30 are assembled, if the span is large, at least one side of the ceiling assembly 40 is coated with a precoat 41 that dries to form a hard, reinforcing shell. Suitable precoat materials 41 for use with polystyrene blocks 30 would be polyurethane or polyurea elastomer coatings. If the span is smaller, the assembly 40 is raised into position without the coating.

Figure 17:
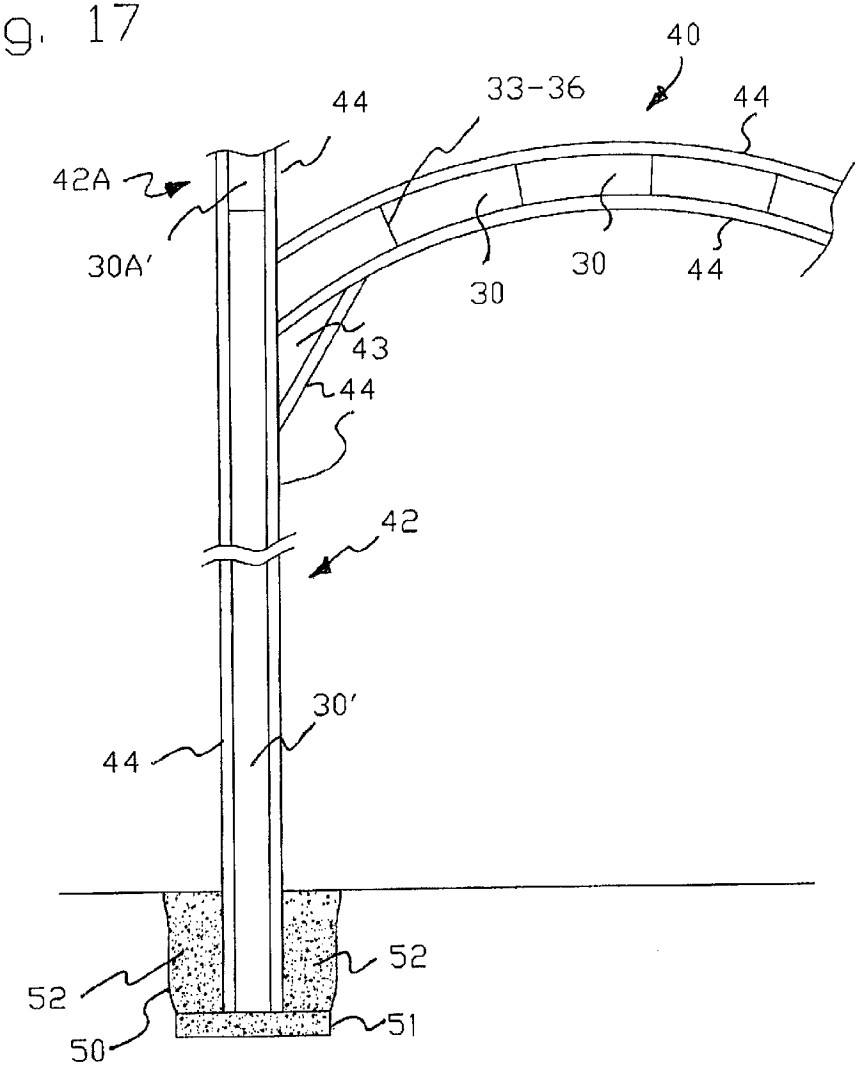
FIG. 17 is cross-sectional view of a portion of the habitable enclosure.

FIG. 17 shows side walls 42 which are formed by joining 4 foot ×8 foot ×2–12 inch foam blocks 30' along their long sides with adhesives, interlocking joints or other joining devices. The side walls 42 are positioned on concrete footings 51 in the trench 50 in the ground. Once the side walls 42 are erected, a cornice 43 or other ceiling support which can be formed from foam blocks is added to the top area of the side wall 42 by foam adhesive 39. The cornice 42 is cut in a curve to follow the curvature of the ceiling where the ceiling meets the side walls 42. The ceiling assembly is joined to the cornice, preferably by foam adhesive 39. The side walls 42 and cornice 43 can be coated with a high strength coating 44 before the ceiling assembly is raised into position on the cornice 43 or ceiling support. However, the use of the high strength coating 44 on the side walls and cornice can usually wait until after the ceiling assembly is raised into place on the cornice.

The high strength coating 44 can be made of a resin having fibers of glass, carbon, etc. or a high performance, fiber reinforced concrete with a polymer additive for accelerated curing. A suitable concrete would be glass fiber reinforced concrete (GFRC) which can be sprayed on to the previous coating 41 or onto the foam 30. The GFRC is 3–5% of Cem-FIL TM fibers (glass fibers), manufactured bv THE VEROTEX Company that are mixed into a 1:1 cement: sand and water matrix. Preferably, the coating 40 is made from a very thin layer of GFRC, such as 3/16–½ inches.

Once the ceiling assemblies 40 are in place, the coating 44 can be applied to unite the adjacent assemblies 40 to each other and the assemblies 40 to the side walls 42 and cornice 43 or ceiling support. The top side of the ceiling assembly 40 and the adjacent side walls or ribs 42A are also coated with the high strength coating 44. The side walls 42, 42A are also coated inside and outside with coating 44. Once the lower portion of the side walls 42 has been coated, concrete fill 52 can be added to the trench 50.

Figure 17A:
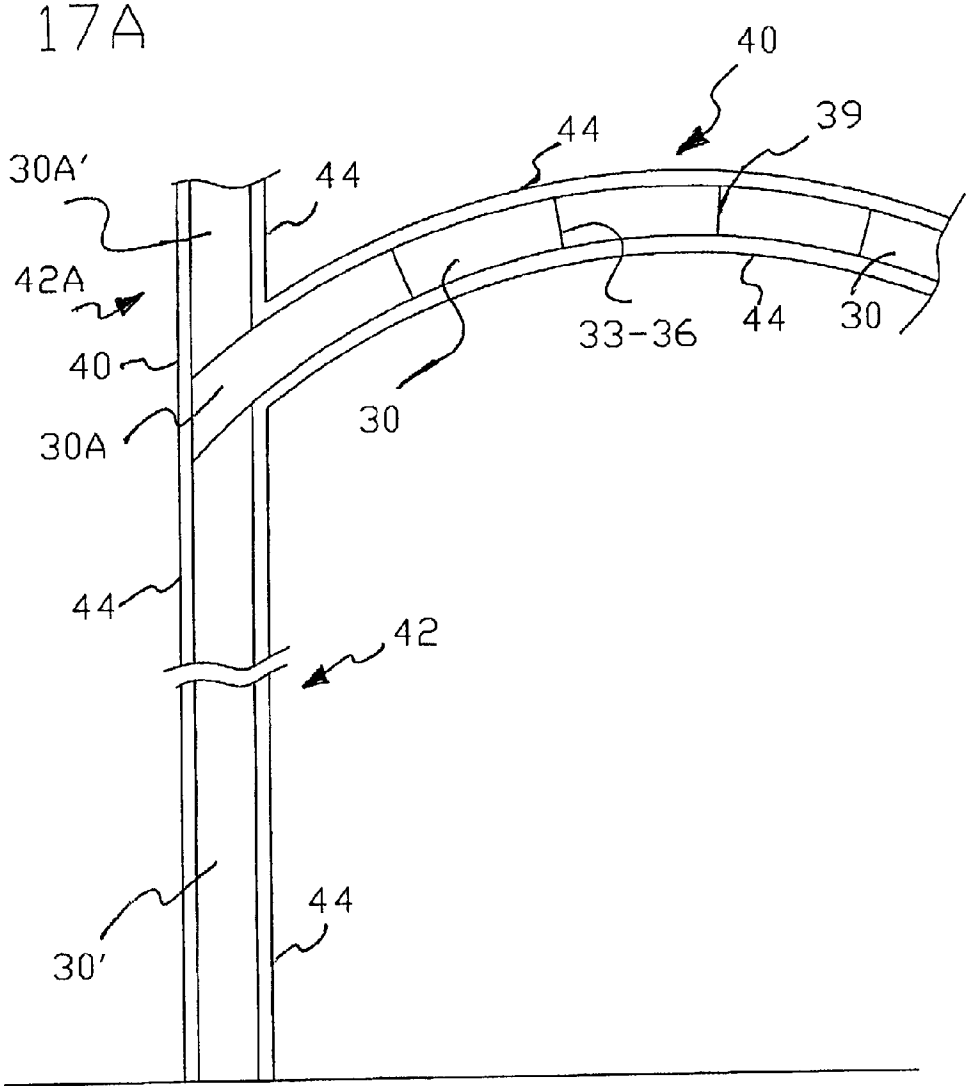
FIG. 17A is a cross-sectional view of another embodiment of a portion of the habitable enclosure.

As shown in FIG. 17A, the side wall 42 can be cut to receive the ceiling assembly 40. In this embodiment, the side wall 42 does not need a cornice 43 to support the assembly 40. The outer foam blocks 30A are trimmed by the use of a hot wire to match the side of the side wall 42. The ceiling assembly 40 is joined to the side wall 42 at its top, preferably by foam adhesives 39. A foam block 30A' is formed to fit the curvature of the ceiling block 30A and is joined thereto. Foam block 30A' extends the side wall 42 past the ceiling assembly 40 to form an attic side wall or rib 42A.

Figure 18:
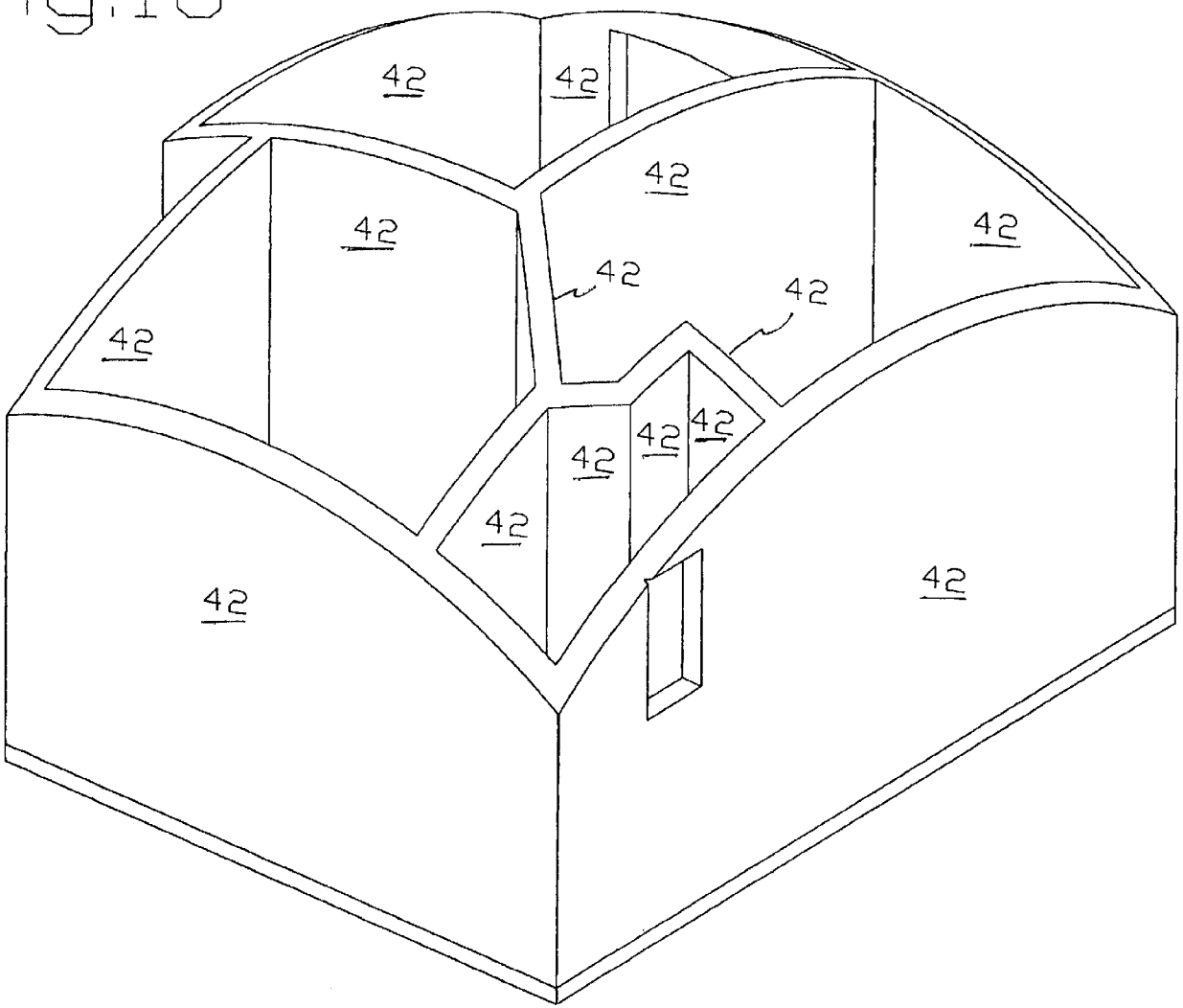
FIG. 18 shows a perspective view of the first floor of one example of a habitable enclosure constructed according to the second embodiment.
Figure 19A:
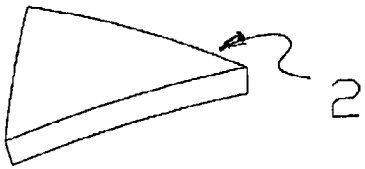
FIG. 19A shows a section of the ceiling assembly of FIG. 19.
Figure 19:
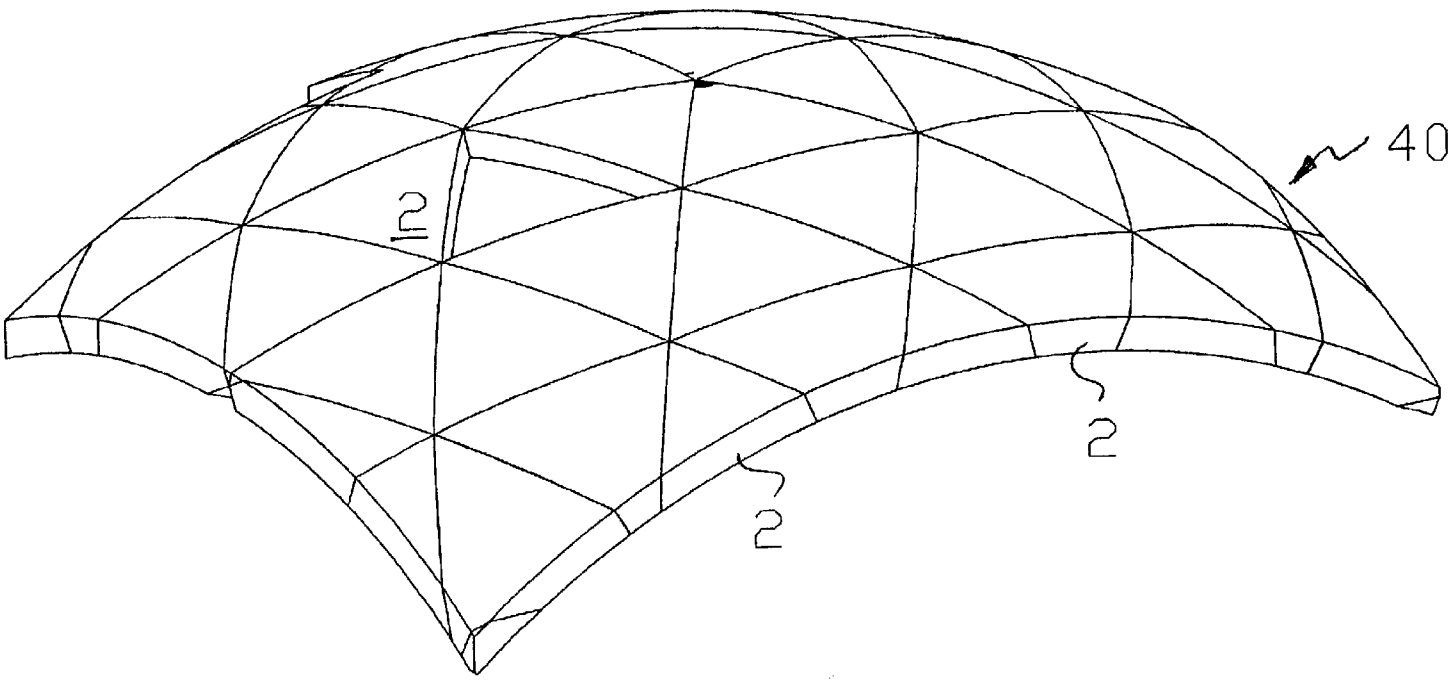
FIG. 19 shows a perspective view of the ceiling assembly.
Figure 20:
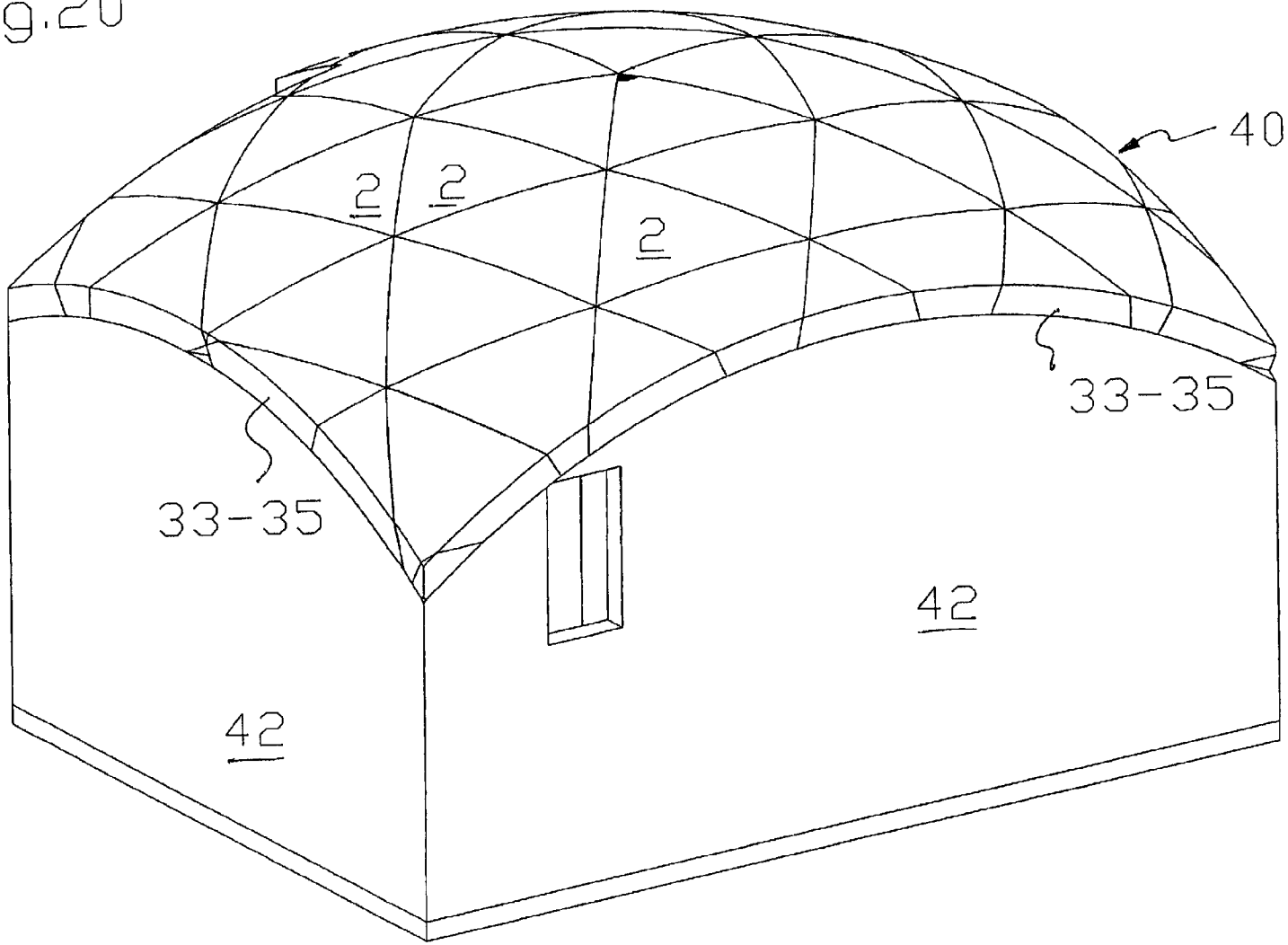
FIG. 20 shows a perspective view of the ceiling assembly in place on the side walls.
Figure 21:
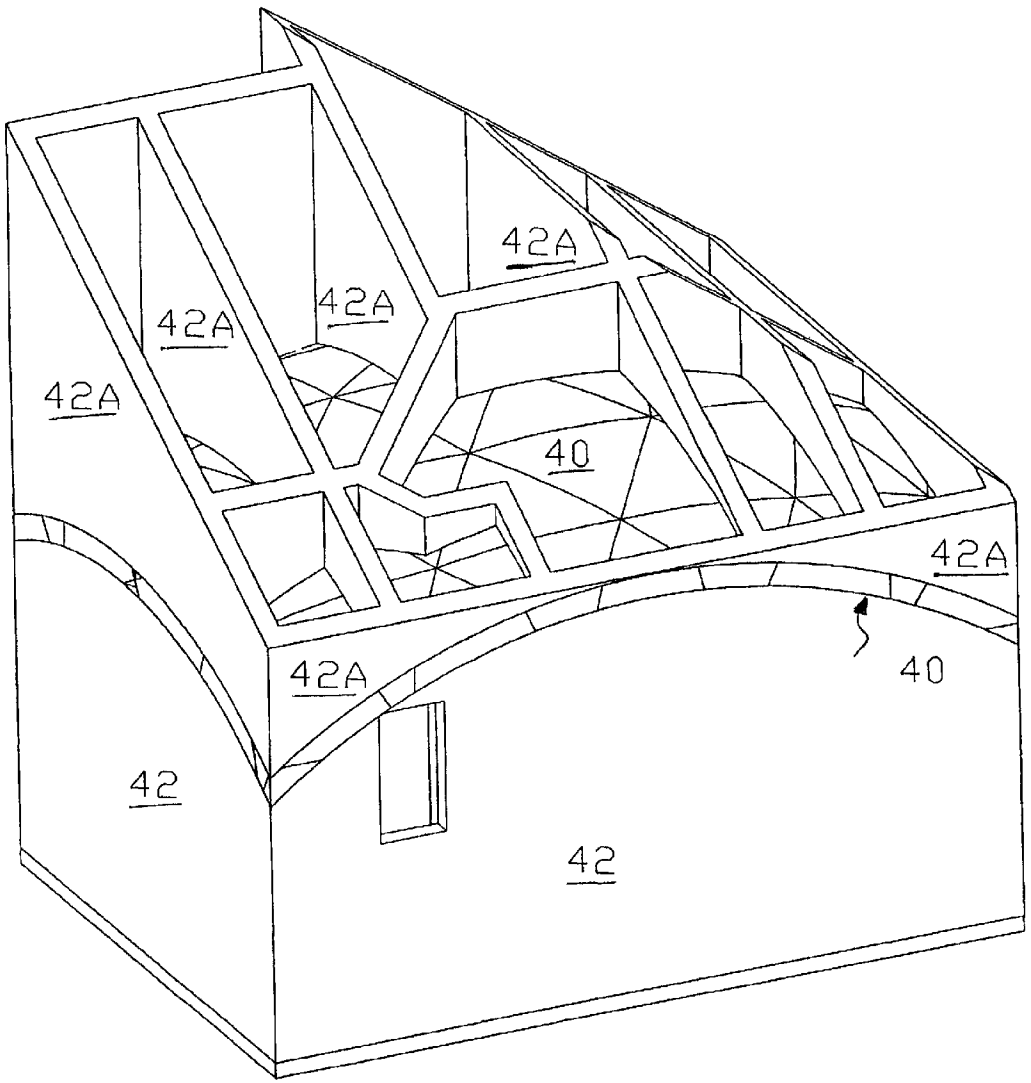
FIG. 21 shows a perspective view of the attic side walls added to the enclosure.
Figure 22:
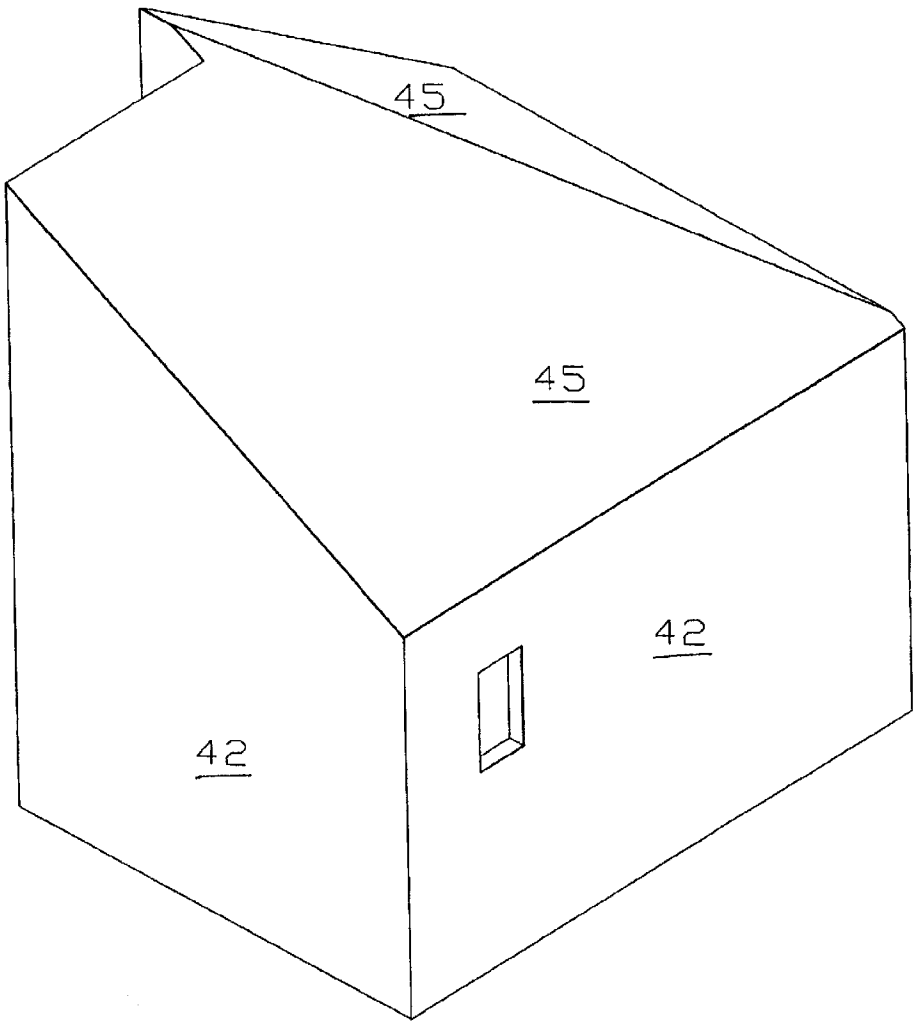
FIG. 22 shows a perspective view of the roof added to the enclosure.

FIGS. 17–22 show an example of a habitable enclosure created by the method of the second embodiment. FIG. 18 shows the side walls 42 of a first floor with the high strength coating. FIG. 19 shows the uncoated ceiling 40 that is placed on the side walls 42 with one of the triangular sections 2 exploded into FIG. 19A. FIG. 20 shows the ceiling assembly 40 in place on the side walls 42. The sides 33–35 of sections 2 are trimmed by a hot wire to match the uncoated, side wall or rib 42. FIG. 21 shows the attic side walls 42A. The ceiling assembly 40 is shown as uncoated to more clearly show its form. FIG. 22 shows the roof 45 added to the side walls 42. All of the exterior surfaces, roof and walls, will be coated to provide additional strength. The ceiling assembly 40 is shown as uncoated on its exterior side as in FIGS. 20–22 to more clearly show its form where it lays on the first floor side walls 42.

CAD programs are available as AutoCad TM, ProE TM, Solid Works TM, Inventor TM, etc. CAM programs are available as Fast CAM TM, etc.

some of the curvatures have been exaggerated from what would be the usual curvature so the curvature of the elements will be more apparent.

What is claimed is:

1. The method of providing a composite curved structure as part of a habitable building comprising the steps of, creating a drawing of the curved structure with the aid of a computer by using a computer assisted drafting program, said structure having a curved surface, dividing the drawing of the curved structure into sections, forming the sections from a core material of plastic foam, forming the curvature of the surface of the structure in the surface of the core material by cutting away portions of the plastic foam, joining the sections to form the curved structure, and coating the curved surface of the structure with a material that hardens into a strong layer.

2. The method of claim 1 wherein, the curved structure has opposed curved surfaces.

3. The method of claim 1 wherein, the step of forming the curvature is performed by a computer assisted cutting machine that receives data from the computer assisted drafting program to guide the machine in forming.

4. The method of claim 1 including the step of, coating an opposed surface of the structure with a material that hardens into a strong layer.

5. The method of claim 1 wherein, the material that hardens into a strong layer is fiber reinforced concrete.

6. The method of claim 1 wherein, the core material is expanded polystyrene foam.

7. The method of claim 1 wherein, the material that hardens into a strong layer is a resin.

* * * * *